US011241347B2

(12) United States Patent
Ribble et al.

(10) Patent No.: US 11,241,347 B2
(45) Date of Patent: Feb. 8, 2022

(54) MATTRESS SUPPORT FOR ADDING HOSPITAL BED MODULAR CONTROL SYSTEM FOR UPGRADING A BED TO INCLUDE MOVABLE COMPONENTS

(71) Applicant: Hill-Rom Services, Inc., Batesville, IN (US)

(72) Inventors: David L. Ribble, Batesville, IN (US); Craig M. Meyerson, Syracuse, NY (US); Lori Zapfe, Milroy, IN (US); John V. Harmeyer, Cleves, OH (US); Xuan Teng, Batesville, IN (US); Jotpreet Chahal, Fayetteville, NY (US); Thomas F. Heil, Batesville, IN (US); Kirsten M. Emmons, Batesville, IN (US); David L. Bedel, Oldenburg, IN (US); Kenneth L. Lilly, West Chester, OH (US); Nicholas Mann, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 180 days.

(21) Appl. No.: 16/583,334

(22) Filed: Sep. 26, 2019

(65) Prior Publication Data

US 2020/0100960 A1 Apr. 2, 2020

Related U.S. Application Data

(60) Provisional application No. 62/739,344, filed on Oct. 1, 2018.

(51) Int. Cl.
*A61G 7/015* (2006.01)
*A61G 7/05* (2006.01)
(Continued)

(52) U.S. Cl.
CPC ..... *A61G 7/015* (2013.01); *A47B 23/06* (2013.01); *A47C 20/048* (2013.01); *A47C 21/00* (2013.01);
(Continued)

(58) Field of Classification Search
CPC ..... A61G 7/015; A61G 7/018; A47C 20/04; A47C 20/048; A47C 21/00
See application file for complete search history.

(56) References Cited

U.S. PATENT DOCUMENTS 948,644 A 2/1910 Bjornstad
1,610,898 A 12/1926 Steiner
(Continued)

FOREIGN PATENT DOCUMENTS

DE 1987293 A1 6/1968
JP S5438512 U 3/1979
(Continued)

OTHER PUBLICATIONS

Extended European Search Report, European Application No. 19200203.8, completed Nov. 20, 2019, (7 pages).

*Primary Examiner* — Fredrick C Conley
(74) *Attorney, Agent, or Firm* — Barnes & Thornburg LLP

(57) ABSTRACT

A modular system is usable to vary the conditions around a bed in a home to provide various levels of support for patients who are at home and have varying acuity of medical complications. The modular system allows the home bed to be temporarily adapted for medical care.

20 Claims, 15 Drawing Sheets

(51) Int. Cl.

| | |
|---|---|
| ***A47B 23/06*** | (2006.01) |
| ***A47C 20/04*** | (2006.01) |
| ***A47C 21/00*** | (2006.01) |
| ***A61G 7/018*** | (2006.01) |
| ***A61G 7/053*** | (2006.01) |

(52) U.S. Cl.

CPC ..... *A61G 7/018* (2013.01); *A61G 7/053* (2013.01); *A61G 7/0506* (2013.01); *A61G 7/0516* (2016.11); *A61G 7/0524* (2016.11); *A61G 2203/10* (2013.01)

(56) References Cited

U.S. PATENT DOCUMENTS

| | | | | |
|---|---|---|---|---|
| 2,612,645 | A | 10/1952 | Boland | |
| 2,887,692 | A | 5/1959 | Gosman | |
| 3,392,412 | A | 7/1968 | Aymar | |
| 3,426,373 | A | 2/1969 | Scott et al. | |
| 3,606,623 | A | 9/1971 | Aymar | |
| 3,667,075 | A | 6/1972 | Ballard | |
| 3,781,928 | A * | 1/1974 | Swallert | A47C 20/048 5/660 |
| 3,835,486 | A * | 9/1974 | Benoit | F16B 7/1409 5/503.1 |
| 4,142,263 | A | 3/1979 | Pierson | |
| 4,150,284 | A | 4/1979 | Trenkler et al. | |
| 4,151,407 | A | 4/1979 | Delagi et al. | |
| 4,165,125 | A | 8/1979 | Owen | |
| 4,183,015 | A | 1/1980 | Drew et al. | |
| 4,216,462 | A | 8/1980 | Digiacomo et al. | |
| 4,225,953 | A | 9/1980 | Simon et al. | |
| 4,228,426 | A | 10/1980 | Roberts | |
| 4,237,344 | A | 12/1980 | Moore | |
| 4,298,863 | A | 11/1981 | Natitus et al. | |
| 4,309,783 | A | 1/1982 | Cammack et al. | |
| 4,331,953 | A | 5/1982 | Blevins et al. | |
| 4,527,298 | A | 7/1985 | Moulton | |
| 4,542,547 | A | 9/1985 | Sato | |
| 4,554,693 | A | 11/1985 | Calloway | |
| 4,577,185 | A | 3/1986 | Andersen | |
| 4,578,671 | A | 3/1986 | Flowers | |
| 4,593,273 | A | 6/1986 | Narcisse | |
| 4,598,275 | A | 7/1986 | Ross et al. | |
| 4,601,064 | A | 7/1986 | Shipley | |
| 4,649,385 | A | 3/1987 | Aires et al. | |
| 4,680,790 | A | 7/1987 | Packard et al. | |
| 4,814,751 | A | 3/1989 | Hawkins et al. | |
| 4,839,932 | A | 6/1989 | Williamson | |
| 4,850,040 | A | 7/1989 | Teich et al. | |
| 4,877,288 | A | 10/1989 | Lee | |
| 4,932,089 | A | 6/1990 | Laviero | |
| 4,955,000 | A | 9/1990 | Nastrom | |
| 4,967,195 | A | 10/1990 | Shipley | |
| 4,990,892 | A | 2/1991 | Guest et al. | |
| 4,998,095 | A | 3/1991 | Shields | |
| 4,998,939 | A | 3/1991 | Potthast et al. | |
| 5,012,539 | A | 5/1991 | Grigg | |
| 5,036,852 | A | 8/1991 | Leishman | |
| 5,060,174 | A | 10/1991 | Gross | |
| 5,062,151 | A | 10/1991 | Shipley | |
| 5,065,154 | A | 11/1991 | Kaiser et al. | |
| 5,086,290 | A | 2/1992 | Murray et al. | |
| 5,103,108 | A | 4/1992 | Crimmins | |
| 5,124,991 | A | 6/1992 | Allen | |
| 5,137,033 | A | 8/1992 | Norton | |
| 5,144,284 | A | 9/1992 | Hammett | |
| 5,153,584 | A | 10/1992 | Engira | |
| 5,170,522 | A | 12/1992 | Walker | |
| 5,184,112 | A | 2/1993 | Gusakov | |
| 5,195,198 | A | 3/1993 | Travis | |
| 5,253,656 | A | 10/1993 | Rincoe et al. | |
| 5,269,388 | A | 12/1993 | Reichow et al. | |
| 5,276,432 | A | 1/1994 | Travis | |
| 5,311,625 | A | 5/1994 | Barker et al. | |
| 5,345,630 | A | 9/1994 | Healy | |
| 5,353,012 | A | 10/1994 | Barham et al. | |
| 5,415,167 | A | 5/1995 | Wilk | |
| 5,432,967 | A | 7/1995 | Raftery | |
| 5,490,295 | A | 2/1996 | Boyd | |
| 5,528,783 | A | 6/1996 | Kunz et al. | |
| 5,542,136 | A * | 8/1996 | Tappel | A61G 7/05776 5/658 |
| 5,577,278 | A | 11/1996 | Barker et al. | |
| 5,621,931 | A | 4/1997 | Hamilton | |
| 5,715,548 | A | 2/1998 | Weismiller et al. | |
| 5,838,223 | A | 11/1998 | Gallant et al. | |
| 5,844,488 | A | 12/1998 | Musick | |
| 5,867,821 | A | 2/1999 | Ballantyne et al. | |
| 5,877,675 | A | 3/1999 | Rebstock et al. | |
| 5,933,488 | A | 8/1999 | Marcus et al. | |
| 5,936,539 | A | 8/1999 | Fuchs | |
| 5,942,986 | A | 8/1999 | Shabot et al. | |
| 5,944,659 | A | 8/1999 | Flach et al. | |
| 5,963,137 | A | 10/1999 | Waters | |
| 6,009,873 | A | 1/2000 | Neviaser | |
| 6,093,146 | A | 7/2000 | Filangeri | |
| 6,097,308 | A | 8/2000 | Albert et al. | |
| 6,111,509 | A | 8/2000 | Holmes | |
| 6,125,350 | A | 9/2000 | Dirbas | |
| 6,131,219 | A | 10/2000 | Roberts | |
| 6,133,837 | A | 10/2000 | Riley | |
| 6,142,592 | A | 11/2000 | Grittke et al. | |
| 6,183,417 | B1 | 2/2001 | Geheb et al. | |
| 6,208,250 | B1 | 3/2001 | Dixon et al. | |
| 6,397,416 | B2 | 6/2002 | Brooke et al. | |
| 6,684,425 | B2 | 2/2004 | Davis | |
| 7,154,397 | B2 | 12/2006 | Zerhusen et al. | |
| 7,568,246 | B2 | 8/2009 | Weismiller et al. | |
| 7,669,263 | B2 | 3/2010 | Menkedick et al. | |
| 7,690,059 | B2 | 4/2010 | Lemire et al. | |
| 7,852,208 | B2 | 12/2010 | Collins, Jr. et al. | |
| 8,536,990 | B2 | 9/2013 | Collins, Jr. et al. | |
| 8,656,541 | B2 | 2/2014 | Muollo | |
| 8,789,224 | B2 | 7/2014 | Wyatt et al. | |
| 2003/0041378 | A1 | 3/2003 | Davis | |
| 2003/0150058 | A1 | 8/2003 | Davis | |
| 2003/0196270 | A1 | 10/2003 | Leventhal et al. | |
| 2006/0101578 | A1 * | 5/2006 | Shalikar | A61G 7/0516 5/426 |
| 2006/0117482 | A1 | 6/2006 | Branson | |
| 2006/0123550 | A1 | 6/2006 | Davis | |
| 2006/0230539 | A1 | 10/2006 | Goodman | |
| 2008/0147442 | A1 | 6/2008 | Warner et al. | |
| 2016/0331616 | A1 | 11/2016 | Fisk et al. | |
| 2018/0333082 | A1 | 11/2018 | Hoffman et al. | |

FOREIGN PATENT DOCUMENTS

| | | | |
|---|---|---|---|
| JP | H01238859 | A | 9/1989 |
| JP | H04297257 | A | 10/1992 |
| WO | 2013134638 | A1 | 9/2013 |
| WO | 2014117128 | A1 | 7/2014 |

* cited by examiner

MATTRESS SUPPORT FOR ADDING HOSPITAL BED MODULAR CONTROL SYSTEM FOR UPGRADING A BED TO INCLUDE MOVABLE COMPONENTS

PRIORITY CLAIM

This application claims priority under 35 U.S.C. § 119(e) to U.S. Provisional Application No. 62/739,344, filed Oct. 1, 2018, which is expressly incorporated by reference herein.

TECHNICAL FIELD

The present disclosure is related to methods and systems for providing hospital-bed like capabilities for a typical at home bed to be used with patients who are treated at home, but who have acuity levels similar to hospitalized patients. More specifically, the present disclosure is related to providing lifting mechanisms, siderail mechanisms, and equipment support structures to be used with a typical at home bed.

BACKGROUND

The present disclosure is related to a bed assembly. Specifically, the present disclosure relates to a bed assembly that is compatible with a traditional consumer bed and can enhance the traditional consumer bed so it provides features of a traditional hospital bed. Such features include the ability to elevate the head section of the traditional consumer mattress using a mattress support having inflatable air bladders.

Extended hospitalization of a patient is an ongoing challenge due to the high cost incurred by the patient and the hospital. At-home care is also challenging due to the high cost, difficulty, and complexity of equipping the home for patient care. While several systems and methods exist for equipping the home for patient care, opportunity exists for continued development in this area.

SUMMARY

The present disclosure includes one or more of the features recited in the appended claims and/or the following features which, alone or in any combination, may comprise patentable subject matter.

According to a first aspect of the present disclosure, a modular system for upgrading a home bed having a mattress to move portions of the bed, includes a head end articulator, a siderail and a control box. The head end articulator includes a lower plate, an upper plate pivotably coupled to the lower plate, and an expandable structure operable to move the upper plate relative to the lower plate to pivot the upper plate and cause a head end of the mattress to raise. The siderail is supported from the upper plate to move with the upper plate as the upper plate moves relative to the lower plate. The control box is operable to control the operation of the head end articulator.

In some embodiments, the modular system further comprises a user interface supported on the siderail.

In some embodiments, the user interface includes user inputs to control the operation of the head end articulator.

In some embodiments, the control box includes a power supply, a controller, and a compressor.

In some embodiments, the power supply provides a low wattage power source for supporting equipment.

In some embodiments, the modular system includes an egress handle.

In some embodiments, the egress handle clamps to a frame of the bed.

In some embodiments, the egress handle clamps to a foundation of the bed.

In some embodiments, the control box is mounted to a headboard of the bed.

In some embodiments, the modular system further comprises a suspension system for supporting medical equipment adjacent the bed.

In some embodiments, the modular system comprises an overhead arm.

In some embodiments, the overhead arm is supported from the upper plate.

In some embodiments, the overhead arm includes a threaded portion that passes through a portion of the plate and is secured to the plate by the threaded portion.

In some embodiments, the overhead arm is supported by a tapered fit connection.

In some embodiments, the upper plate includes a cup and a portion of the overhead arm is received in the cup.

In some embodiments, the siderail is further supported from the lower plate.

In some embodiments, the siderail is telescopically adjustable.

In some embodiments, the siderail is pivotably coupled to the lower plate.

In some embodiments, the siderail comprises a siderail body that is supported by lockable ball joints such that the siderail body can be adjusted to multiple orientations relative to the mattress.

According to a second aspect of the present disclosure, a modular system for upgrading a home bed having a mattress to move portions of the bed, the modular system comprises a head end articulator, a siderail, and a control box. The head end articulator includes a lower plate, an upper plate pivotably coupled to the lower plate, and an inflatable structure positioned between the upper plate and the lower plate. The inflatable structure operable to move the upper plate relative to the lower plate to pivot the upper plate and cause a head end of the mattress to raise. The siderail is supported from the upper plate to move with the upper plate as the upper plate moves relative to the lower plate. The control box operable to control the operation of the head end articulator.

In some embodiments, the modular system further comprises a user interface supported on the siderail.

In some embodiments, the user interface includes user inputs to control the operation of the head end articulator.

In some embodiments, the control box includes a power supply, a controller, and a compressor.

In some embodiments, the power supply provides a low wattage power source for supporting equipment.

In some embodiments, the modular system includes an egress handle.

In some embodiments, the egress handle clamps to a frame of the bed.

In some embodiments, the egress handle clamps to a foundation of the bed.

In some embodiments, the control box is mounted to a headboard of the bed.

In some embodiments, the modular system further comprises a suspension system for supporting medical equipment adjacent the bed.

In some embodiments, the modular system comprises an overhead arm.

In some embodiments, the overhead arm is supported from the upper plate.

In some embodiments, the overhead arm includes a threaded portion that passes through a portion of the plate and is secured to the plate by the threaded portion.

In some embodiments, the overhead arm is supported by a tapered fit connection.

In some embodiments, the upper plate includes a cup and a portion of the overhead arm is received in the cup.

In some embodiments, the siderail is further supported from the lower plate.

In some embodiments, the siderail is telescopically adjustable.

In some embodiments, the siderail is pivotably coupled to the lower plate.

In some embodiments, the siderail comprises a siderail body that is supported by lockable ball joints such that the siderail body can be adjusted to multiple orientations relative to the mattress.

In some embodiments, the modular system further comprises a foot end articulator that includes a lower plate, an upper plate pivotably coupled to the lower plate, and an inflatable structure positioned between the upper plate and the lower plate. The inflatable structure operable to move the upper plate relative to the lower plate to pivot the upper plate and cause a head end of the mattress to raise.

In some embodiments, the system further comprises a connector securing the head end articulator to the foot end articulator to prevent movement therebetween.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
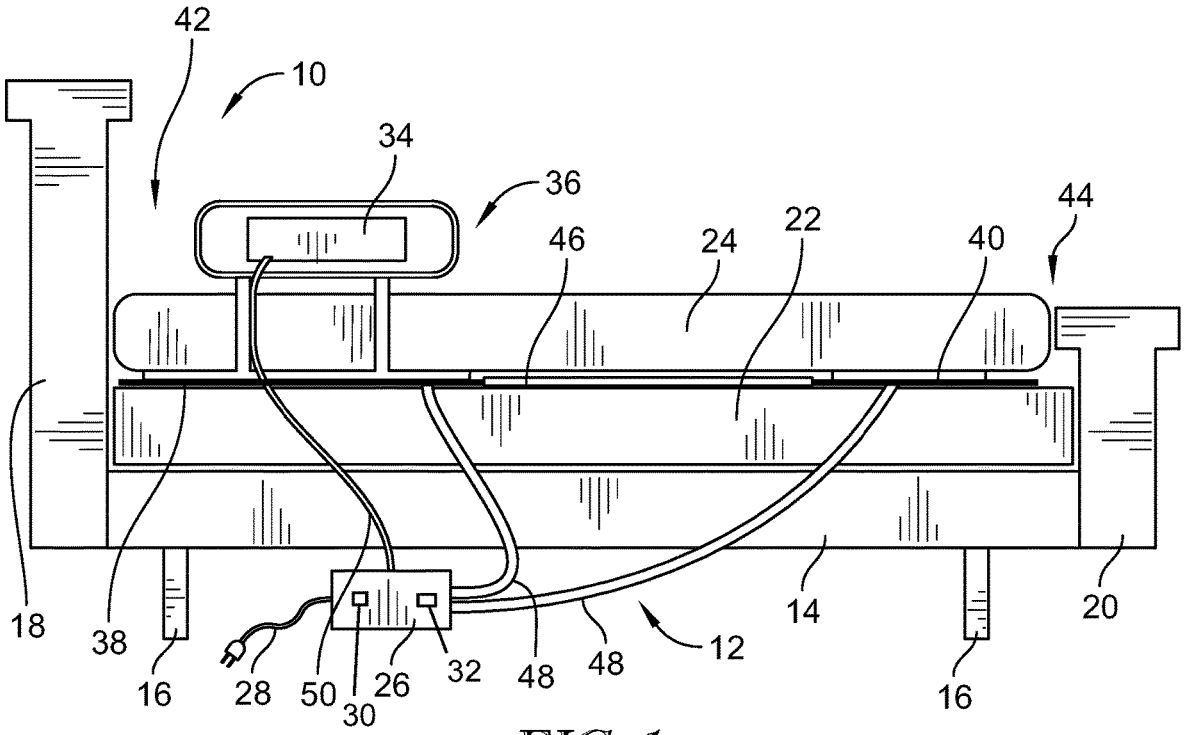
FIG. 1 is a side view of an embodiment of a modular system added to a bed in a home, the modular system including elements which cause movement of portions of the bed.

According to the present disclosure, a typical bed 10 used in a home is modified with a modular system 12 to cause portions of the bed 10 to be movable to various positions that raise the torso and/or legs of a person occupying the bed 10 to various positions. The bed 10 modified with the system 12 is shown in FIG. 1. The bed 10 includes a frame 14 supported on a floor by legs 16. In the illustrative embodiment, the bed 10 includes a headboard 18 and a foot board 20 supported from the frame 14. The bed 10 also includes a foundation 22, illustratively a box spring 22, and a mattress 24, supported on the foundation 22. In other embodiments, one or more portions of the bed 10 may be omitted. For example, the frame 14 may be positioned directly on the floor without legs 16. The headboard 18 and/or the footboard 20 may be omitted. Still further, the frame 14 may be omitted and the foundation 22 may be supported directly on the floor. In still further embodiments, the bed 10 may simply be a mattress 24 supported on the floor.

Figure 2:
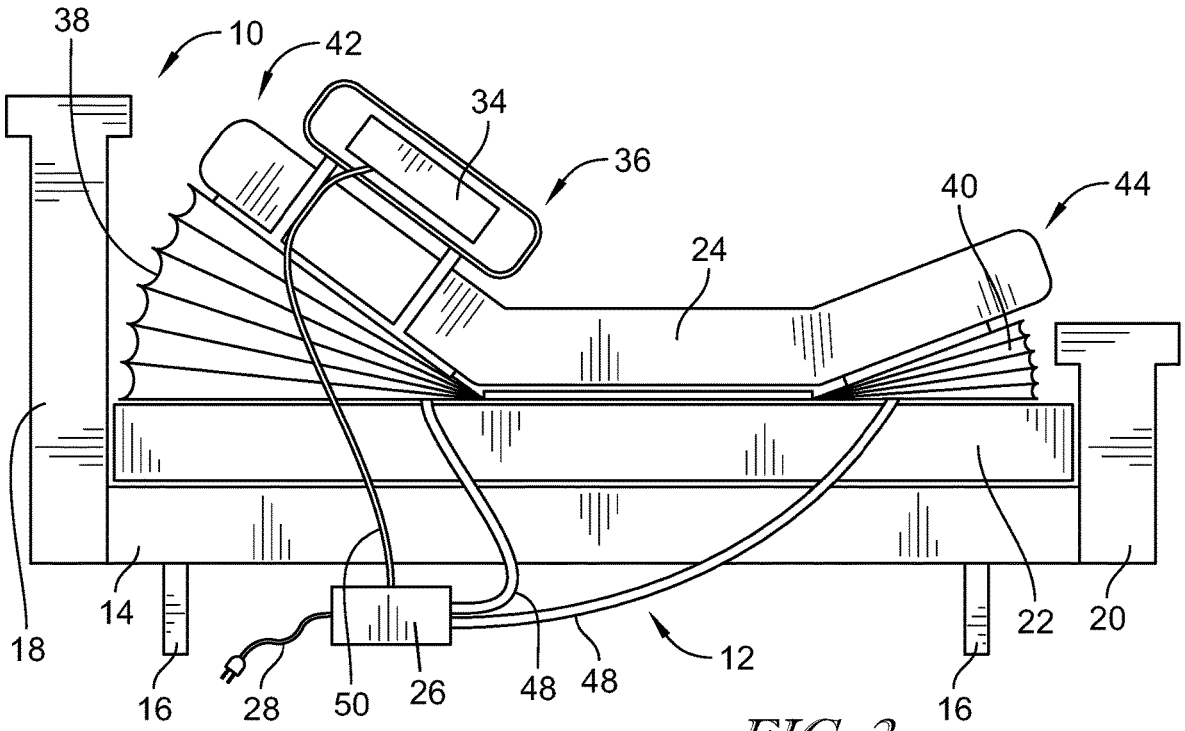
FIG. 2 is a side view similar to the view of FIG. 1, the bed in FIG. 2 having portion moved by the modular system.

According to the present disclosure, the system 12 is configured to be positioned relative to the mattress 24 and add the functionality to move portions of the mattress 24 to raised positions, as suggested by FIG. 2. The system 12 includes a control box 26 which includes a power cord 28 that is connectable directly to a wall outlet in the home. The control box 26 includes a compressor 30 and a controller 32 that is operable to control the operation of the compressor 30 and receive inputs from a user interface 34 positioned on a siderail 36. The compressor 30 is connected to a head end articulator 38 and a foot end articulator 40, each of which includes air bladders (not shown) which are used to lift a head end 42 or a leg end 44 of the mattress 24 as suggested in FIG. 2. The articulators 38 and 40 are secured together by a connector 46 to maintain their position under the mattress 24. The system 12 includes a hose assembly 48 which connects the head end articulator 38 with the control box 26 and a second hose assembly 48 which connects the foot end articulator 40 to the control box 26. A cable 50 connects the user interface 34 to the control box 26. A detailed description of a suitable structure for an articulator is disclosed in to U.S. provisional application No. 62/567,995 filed Oct. 4, 2017 titled "APPARATUS FOR ADDING HOSPITAL BED FUNCTIONALITY TO AN AT-HOME BED" which is incorporated herein for the disclosure of articulator structures.

While the user interface 34 is shown to be integral to the siderail 36, it should be understood that the user interface 34 may be omitted and replaced with a user interface that is mounted directly to the control box 26 or may be replaced by a pendant (not shown) which is independent of the siderail 36 as is known in the art. It should also be understood that either of the articulators 38 or 40 may be omitted. The present disclosure contemplates various embodiments of elements of the system 12 that may be included modularly to arrange the particular implementation of the system 12 for a particular use case. Except where described as mutually exclusive to another component of the system 12, each of the elements described in the embodiments below may be included in an implementation and in some cases, redundant implementations may be included.

Figure 3:
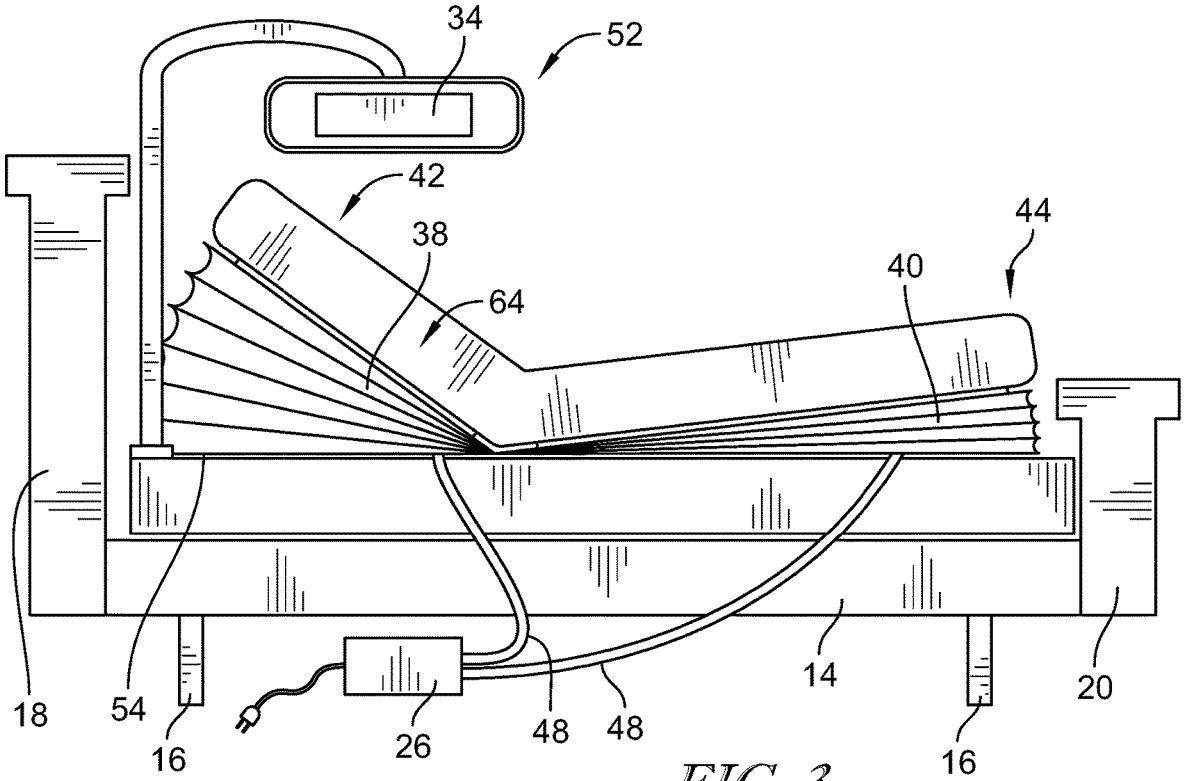
FIG. 3 is a view similar to FIG. 1, with the modular system of FIG. 3 having an overhead arm positioned above a head end of the bed.
Figure 4:
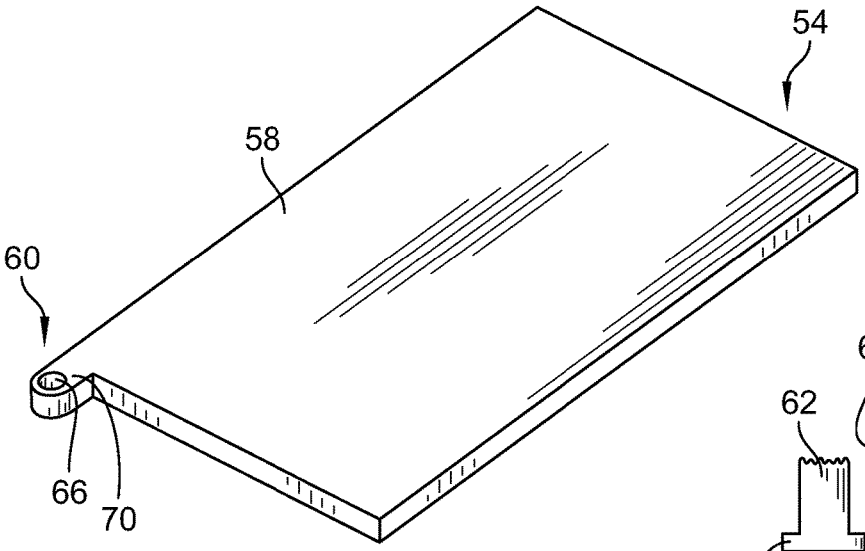
FIG. 4 is a perspective view of a plate of the modular system of FIG. 3, the plate configured to support the overhead arm.
Figure 5:
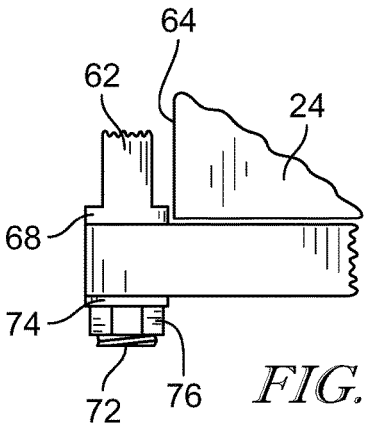
FIG. 5 is a side view, with portions cut-away, of the interface of the overhead arm with the plate of FIG. 4.

For example, as shown in FIG. 3, an overhead arm 52 may be mounted to a plate 54 of the head end articulator 38 and positioned above the head end 42 of the mattress 24. A suitable structure for the overhead arm 52 is disclosed in U.S. application Ser. No. 15/976,984 filed May 11, 2018 and titled "FLEXIBLE OVERHEAD ARM" which is incorporated by reference herein for the disclosure of the overhead arm structure and functionality. Referring now to FIG. 4, a first version of a top plate 54 is embodied as a top plate 56 which includes a plate body 58 and a tab 60 which extends laterally from the body 58. When the plate 56 is positioned under the mattress 24, the mattress 24 is positioned over the body 58 while the tab 60 is positioned away from the mattress 24 so that a shaft 62 may extend past the lateral side 64 (see FIG. 5) of the mattress 24. The tab 60 has a through-hole 66 which receives a portion of the shaft 62 as shown in FIG. 5. The shaft 62 includes a flange 68 that rests on an upper surface 70 of the tab 60. A threaded portion 72 of the shaft 62 extends through the through-hole 66. A washer 74 is positioned on the threaded portion 72 and the shaft 62 is secured to the plate 54 by a nut 76. The flange 68 cooperates with the washer 74 and nut 76 to clamp the shaft 62 to the plate 58. Since the arm 52 is secured to the plate 54 and moves with the plate 54 during movement of the head end articulator 38, the user interface 34 supported on the arm 52 maintains its orientation relative to the person supported on the mattress 24.

Figure 6:
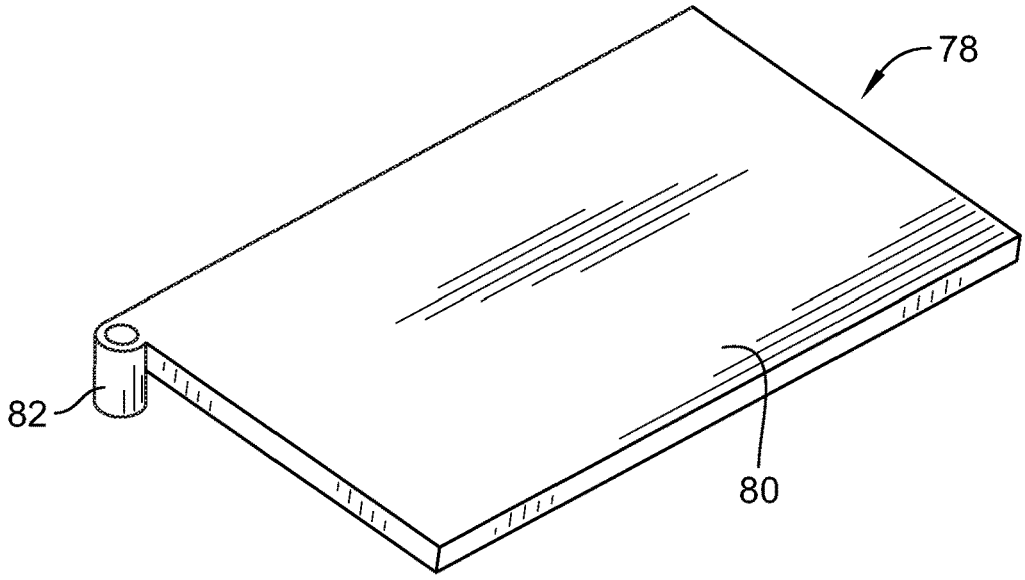
FIG. 6 is a perspective view of a plate that is similar to, but an alternative of, the plate of FIG. 4.
Figure 7:
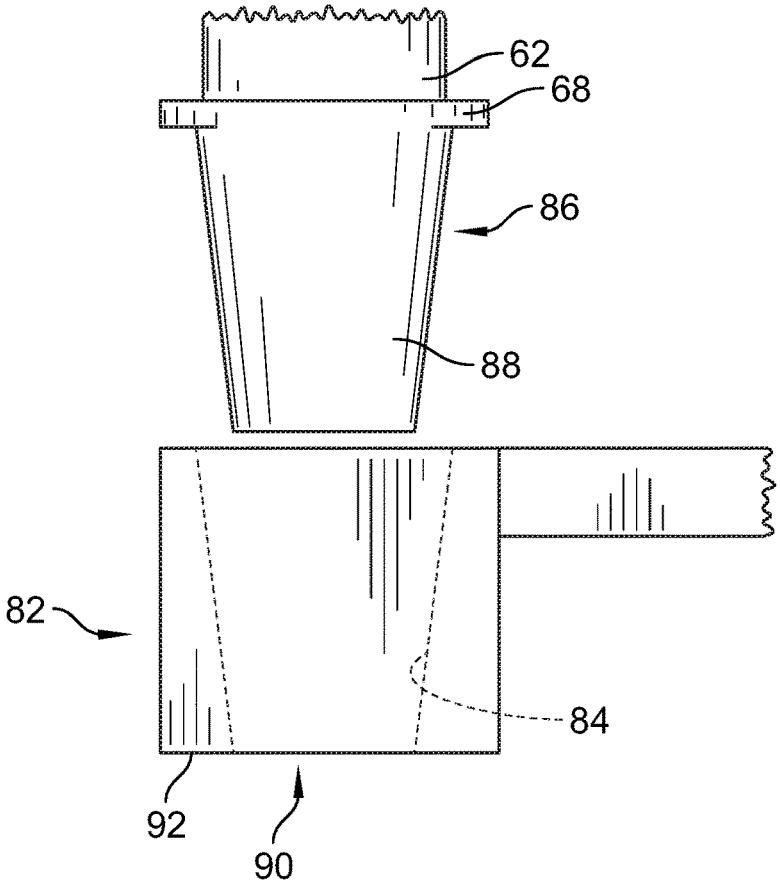
FIG. 7 is a side view, with portions cut-away, of the interface of the overhead arm with the plate of FIG. 6.

In another embodiment shown in FIGS. 6 and 7, the plate 54 is omitted and replaced with an alternative plate 78 that includes a body 80 and a cup 82 secured to the body 80 and extending laterally therefrom. Similar to the arrangement of FIGS. 4 and 5, the cup 82 is positioned such that the shaft 62 of the arm 52 extends past the lateral side 64 of the mattress 24. The cup 82 is formed to include a tapered receiver surface 84 that is an annular surface. The shaft 62 includes the flange 68, but the threaded portion 72 is omitted and replaced with a frusto-conical extension 86 that is configured to engage the tapered receiver surface 84 to form a tapered fit between the surface 88 of the frusto-conical extension 86 and the receiver surface 84 to secure the shaft 62 to the cup 82, and thereby, the plate 78. Once the surface 88 and surface 84 are engaged, the tapered fit maintains the shaft 62 in secure engagement with the plate 78 during movement of the head end articulator 38. The cup 82 has an opening 90 in a lower surface 92 where the tapered receiver surface 84 intersects the lower surface 92. To disengage the shaft 62, a user will insert a punch or similar device and apply a force, such as a tap with a hammer, to separate the shaft 62 and cup 82. Thus, in the embodiment of FIGS. 6 and 7, the arm 52 is secured to the head end articulator 38 with use of tools or fasteners.

Figure 8:
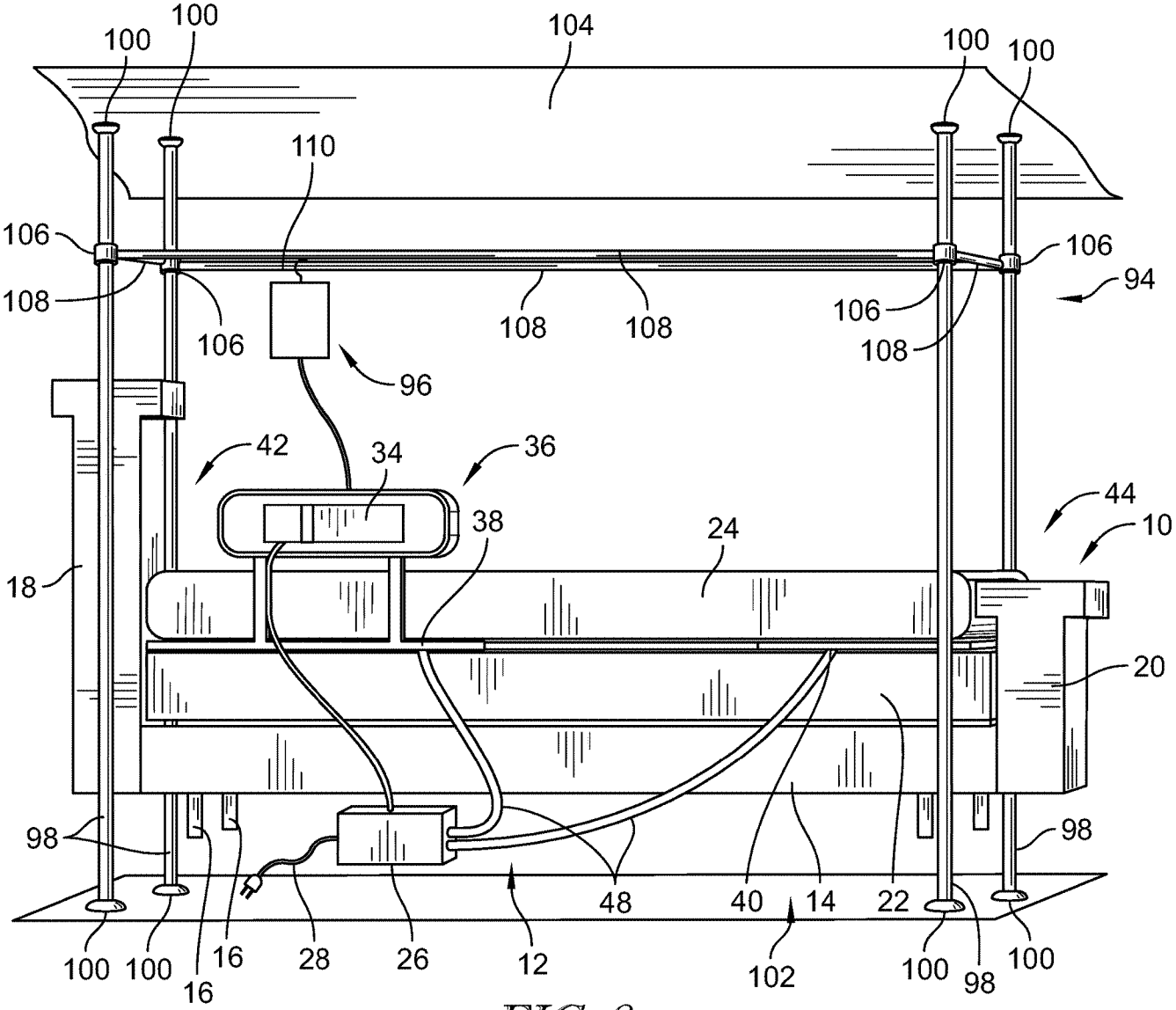
FIG. 8 shows the modular system and bed of FIG. 1; further including a suspension system for supporting medical equipment adjacent to the bed.

Referring now to FIG. 8, the bed 10 is shown with the system 12 shown in FIG. 1, and further including a suspension system 94 that is positioned adjacent the bed 10, with the suspension system 94 providing a support structure for supporting medical care accessories, such as an IV bag 96. The suspension system 94 is configured to be broken-down to be shipped to a home and assembled on site to provide additional functionality at the bed 10 when a person has a medical acuity that requires support for medical accessories 96. For example, the suspension system 94 may support accessories that include the IV bag 96, or other suspended medical accessories such as monitoring equipment, diagnostic equipment, or straps, trapezes, or other handles useful for a patient to assist themselves in exiting the bed 10.

The suspension system 94 illustratively includes four vertical posts 98 which engage with load distributors 100 positioned on the floor 102 and ceiling 104. The load distributors 100 help to distribute the forces exerted by the vertical posts 98. The vertical posts 98 are extensible rods that may be operated as screw jacks to induce a load in the respective post 98 to frictionally secure the posts 98 between the floor 102 and ceiling 104. Once the vertical posts 98 are secured, suspension collars 106 are secured to the posts 98 by a frictional engagement, such as by a hand-tightened set screw (not shown). The suspension collars 106 support horizontal beams 108 between the collars 106. In the illustrative embodiment, the horizontal beams 108 are circular in cross-section and configured to support one or more accessories 96 that hang from the beams 108 by a hook 110. In other embodiments, the beams 108 may be configured to provide accessory tracks for supporting accessories along the tracks, as is known in the art. In still other embodiments, the beams 108 may be formed to include integral hooks.

While the illustrative embodiment of FIG. 8 shows a suspension system 94 with four vertical posts 98 and four horizontal beams 108, in other embodiments, fewer vertical posts and horizontal beams 108 may be used, including a pair of vertical posts 98 and a single beam 108.

Figure 9:
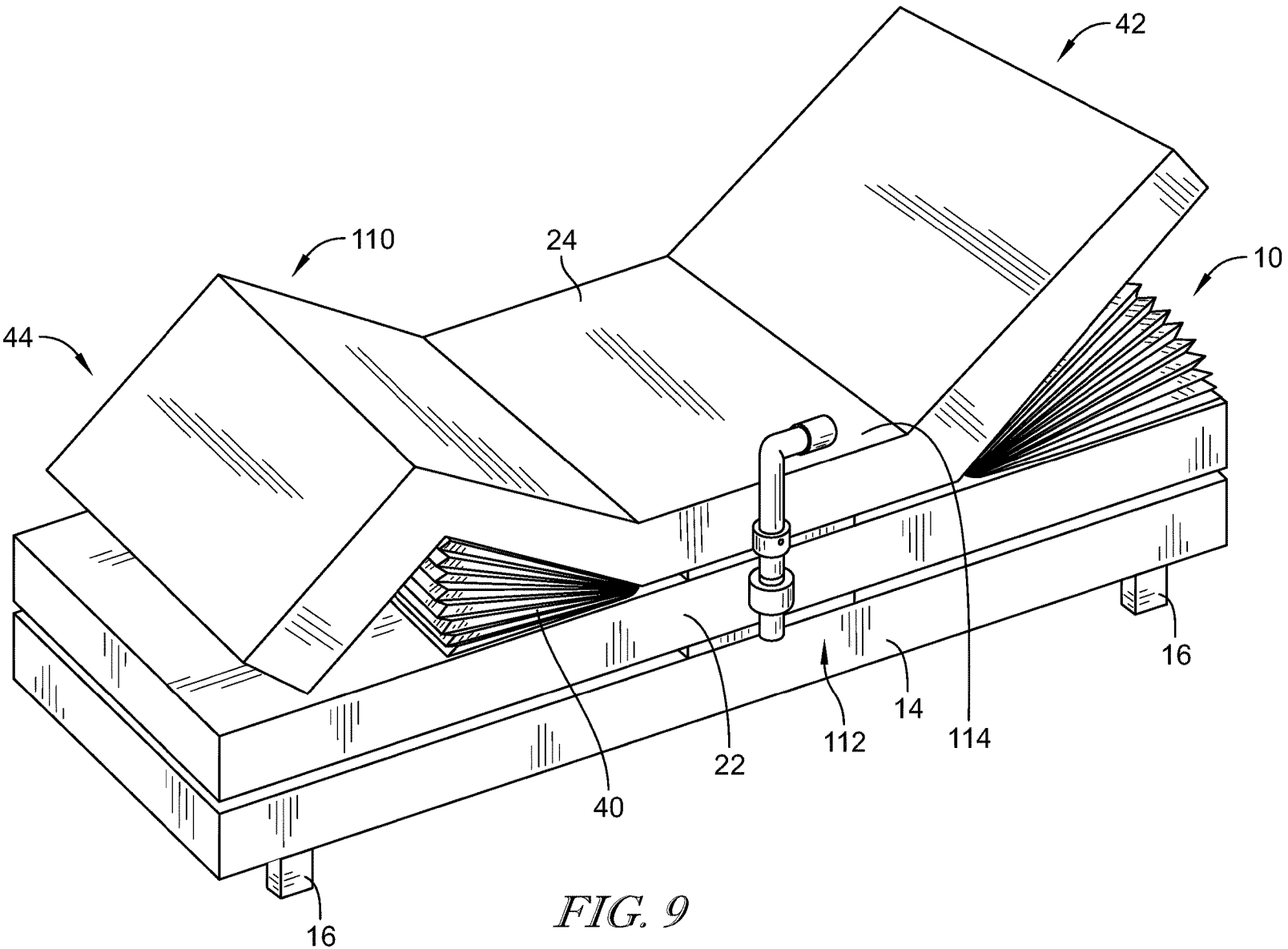
FIG. 9 shows another embodiment of a bed, the bed of FIG. 9 also including an assist handle.

In the embodiment of FIG. 9, the bed 10 has the headboard 18 and footboard 20 omitted. Additionally, the foot end articulator 40 is spaced apart from the edge of the foot end 44 so that the foot end articulator 40 creates a gatch point 110 in the mattress 24 rather than lifting up the entire foot end 44 of the mattress 24. The bed 10 of FIG. 9 includes a egress handle assembly 112 that is configured to be clamped to the foundation 22 to secure the egress handle assembly 112 for support so that the egress handle assembly 112 may be used by a person for support as they exit the bed 10. The egress handle assembly 112 is movable from an upright position shown in FIGS. 9 and 10 to a stowed position below an upper surface 114 of the mattress 24.

Figure 10:
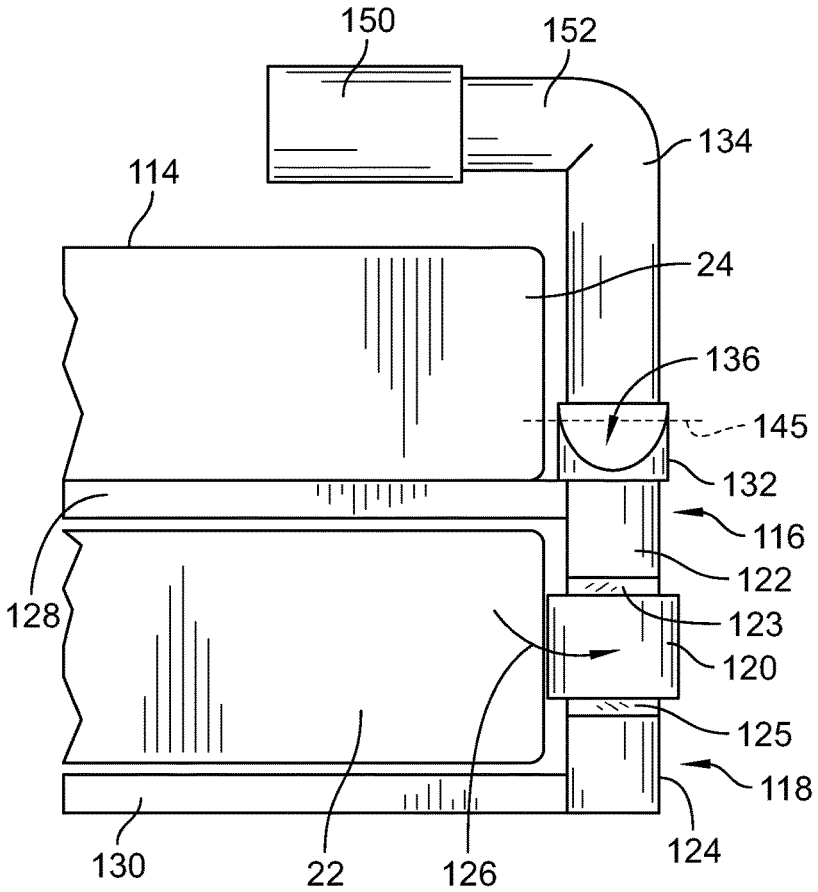
FIG. 10 shows the assist handle of FIG. 9 coupled to a foundation of the bed of FIG. 9.

Referring to FIG. 10, the egress handle assembly 112 includes a pair of clamps arms 116, 118 that are connected by a turnbuckle handle 120. The clamp arm 116 includes a post 122 that has external right-handed threads 123 that are engaged by internal right-handed threads on the turnbuckle handle 120. Similarly, the clamp arm 118 includes a post 124 that has external left-handed threads 125 that are engaged by internal left-handed threads in the turnbuckle handle 120. When the turnbuckle handle 120 is rotated in a first direction 126, the clamp arms 116, 118 are drawn together so that respective plates 128, 130 of the arms 116, 118 are drawing together to clamp onto the foundation 22. With this approach, the egress handle assembly 112 can be secured to the foundation 22 to provide support to a person entering or exiting the bed 10.

Figure 11:
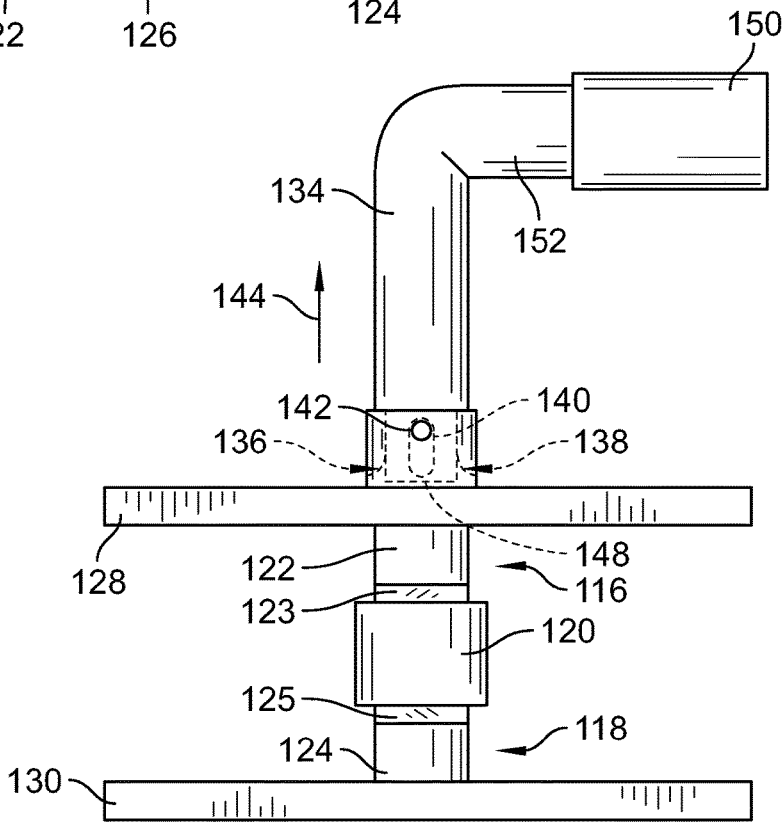
FIG. 11 shows another view of the handle of FIG. 9.

The egress handle assembly 112 further includes a base 132 supported on the post 122. The base 132 supports a handle 134 relative to the clamp arms 116, 118 to provide stability for the handle 134 by transferring the force applied to the handle 134 through the base 132 and the clamp arms 116, 118 to the foundation 22. The base 132 includes channels 136, 138 formed on either side that provide clearance for the handle 134 to be moved to a stowed position. The handle 134 includes a slot 140 (shown in phantom in FIG. 11) that is engaged by a pin 142 secured to the base 132. The slot 140 provides clearance for the handle 134 to be lifted in the direction of arrow 144 until a lower end 146 of the handle 134 clears the channels 136, 138 so that the handle 134 may be rotated about an axis 145 of the pin 142 to a stowed position. When the handle 134 is in the position shown in FIG. 11, the handle 134 engages an interior cylindrical wall 148 formed in the base 132 so that the handle 134 is seated and any loads are transferred through the base 132 and to the foundation 22 as described above. The handle 134 is L-shaped with a grip 150 positioned on a horizontal arm 152 of the handle 134. The arm 152 is accessible by the person entering or exiting the bed 10 for gripping and support.

Figure 12:
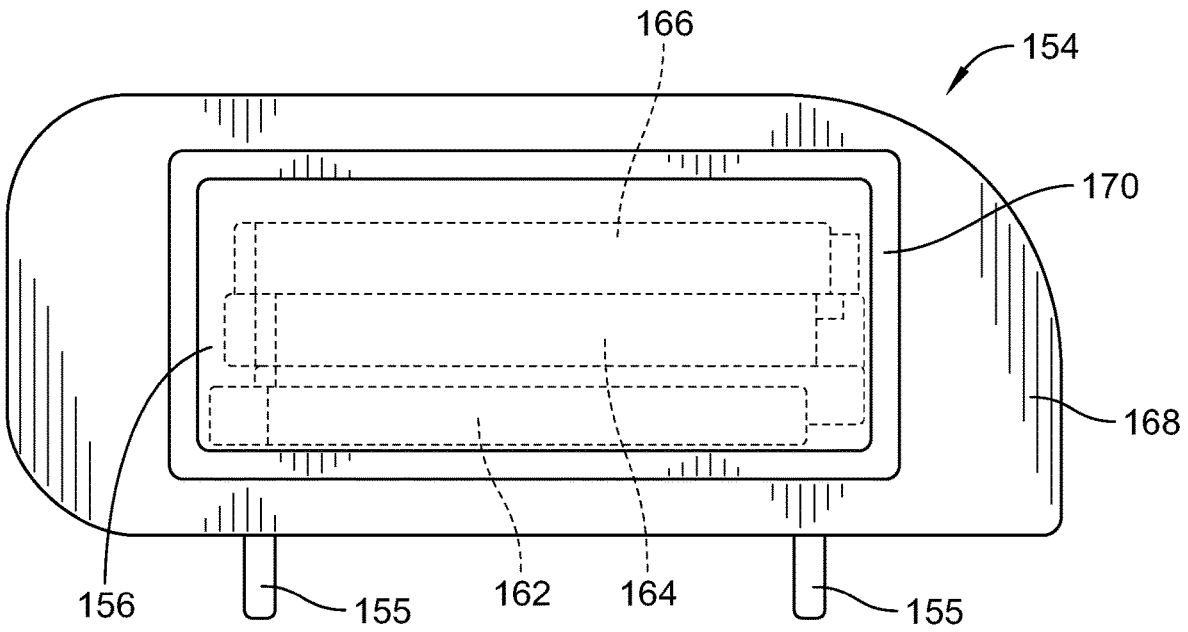
FIG. 12 shows a siderail for a bed, the siderail including a table that is supported by a multi-arm support structure, the support structure positioned behind the table in the stored position.
Figure 13:
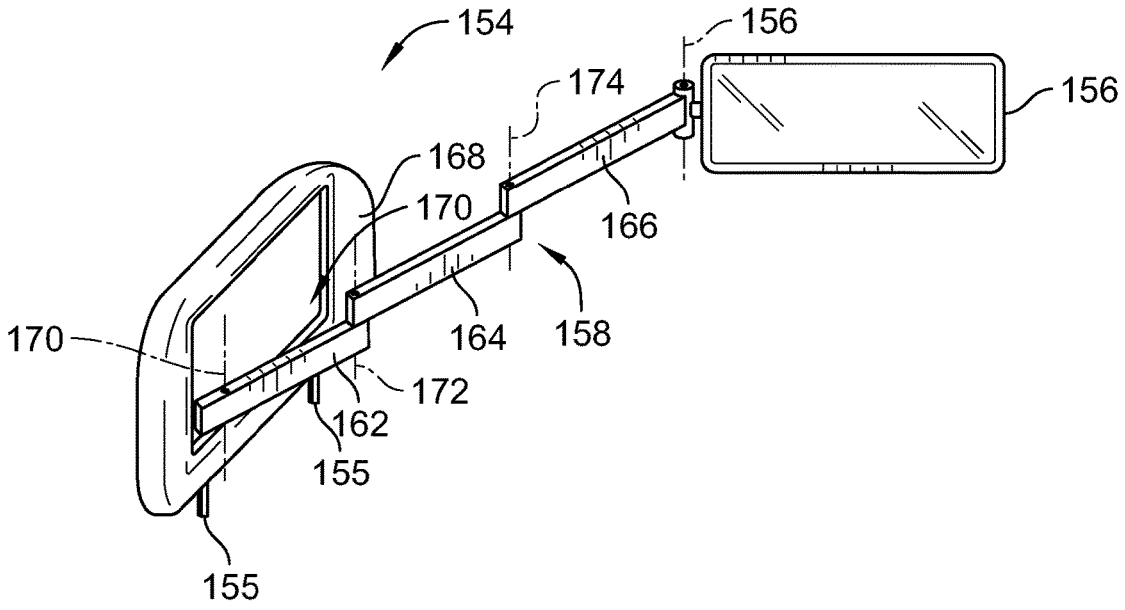
FIG. 13 shows the siderail of FIG. 12 with the table and arm extended away from a body of the siderail.

When a person has a higher acuity illness and is staying in their bed 10 at home, the conveniences available in a hospital setting can be lacking. In an embodiment of a siderail 154 shown in FIG. 12, a table 156 is connected to an adjustable arm assembly 158 (seen best in FIG. 13) and, when stowed, forms a surface 160 of the siderail 154. As seen in FIG. 13, the arm assembly 158 includes three arms 162, 164, 166 that are supported from the siderail body 168 and positioned in a cavity 170 when the table 156 is in the stowed position of FIG. 12.

The arm 162 is pivotably coupled to the siderail body 168 and pivotable about an axis 170. The pivotable connection to the siderail body 168 is frictionally resistant so that a user can reposition the arm 162, but the pivotable connection frictionally maintains the orientation of the arm 162 relative to the body 168. The arm 164 is pivotably coupled to the arm 162 in a similar fashion and pivotable relative to the arm 162 about an axis 172. The arm 166 is similarly pivotable relative to arm 164 about an axis 174.

Figure 14:
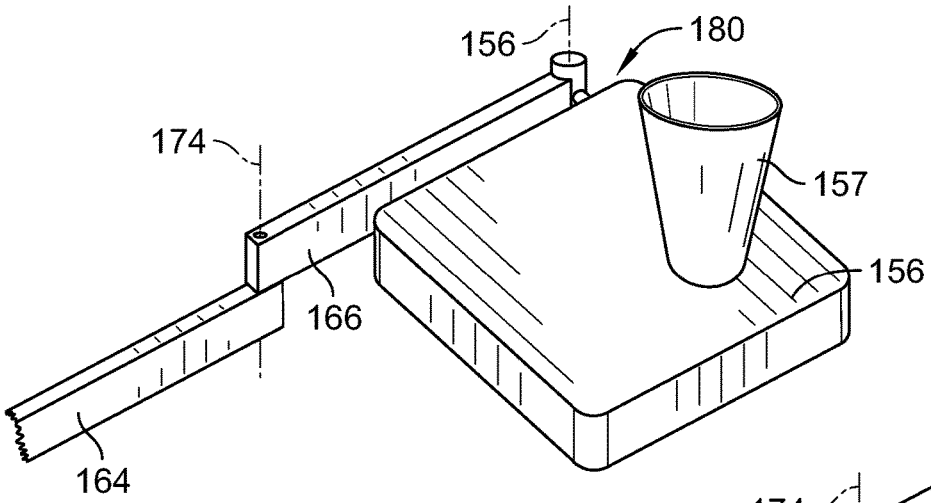
FIG. 14 shows the table of FIGS. 12-13 in a deployed position.

The table 156 is pivotable in two axes 176 and 178 relative to the arm 166 to change orientations as shown in FIG. 14. In the illustrative embodiment, the table 156 is secured to a coupler 180 that is coupled to the arm 166 and pivotable about an axis 176 that is generally vertical. The pivoted connection between the coupler 180 and the arm 166 is similar to the connections between the arms 162, 164, and 166 discussed above in that the arms 162, 164, and 166 are movable about their respective axes, but have a frictional resistance to movement that keeps the arms 162, 164, and 166 in their relative orientations unless an excessive force is applied. The coupler 180 includes a similar friction lock for the axis 178 so that the table 156 is pivotable about the axis 178. However, in other embodiments, the coupler 180 may include a positive locking structure to lock the table 156 in a particular orientation relative to the arm 166. For example, the coupler 180 may include one or more manually releaseable wrap-spring brake mechanisms, a cam-lock structure as is known in the art, or even a hand-tightened set screw lock.

Figure 15:
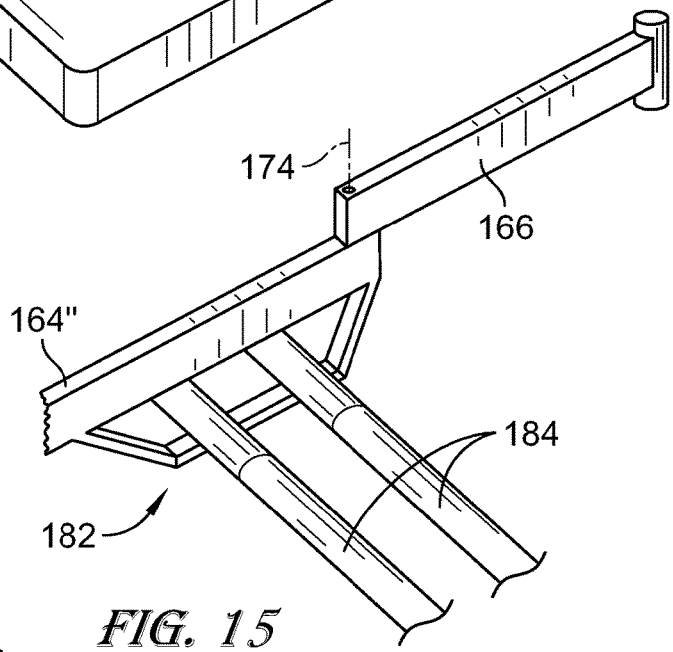
FIG. 15 shows an alternative embodiment of an arm of the multi-arm support structure of FIG. 12, the arm including a guide for supporting hoses or cords.
Figure 16:
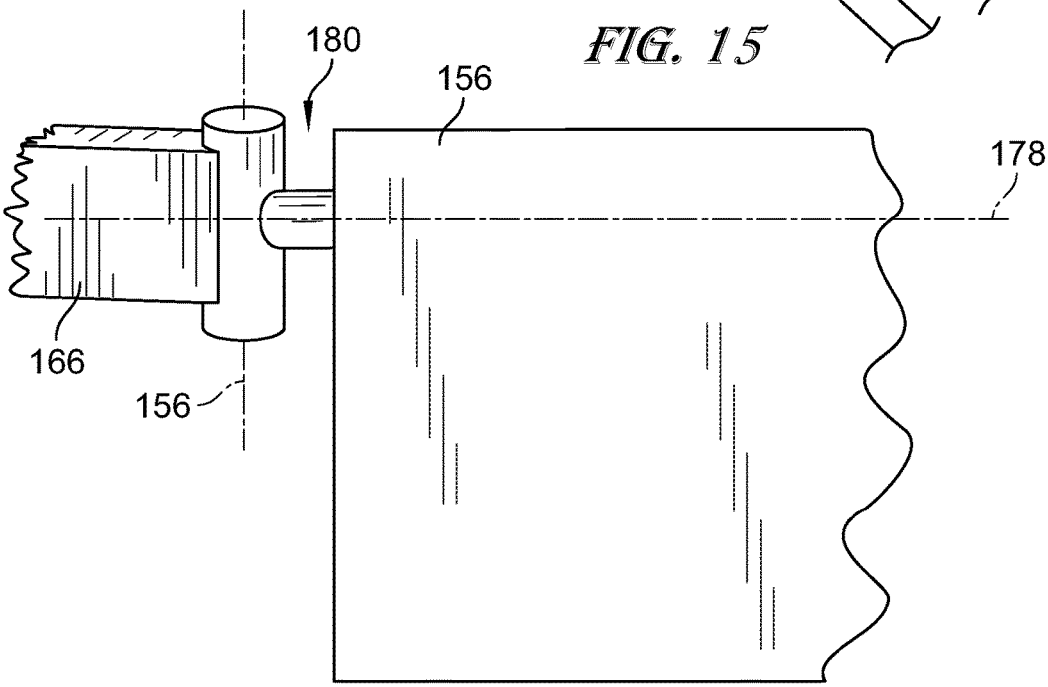
FIG. 16 shows a coupler supporting the table of the FIGS. 12-14 from an arm of the multi-arm support structure.

Referring now to FIG. 15, one or more of the arms 162, 164, 166 may include a routing structure 182 for routing hoses 184 or cords through the routing structure when the table 156 is being used. The structure(s) 182 provide a hook to loop the hoses 184 through to keep the hoses 184 from becoming entangled in bedsheets or other portions of the bed 10.

Figure 17:
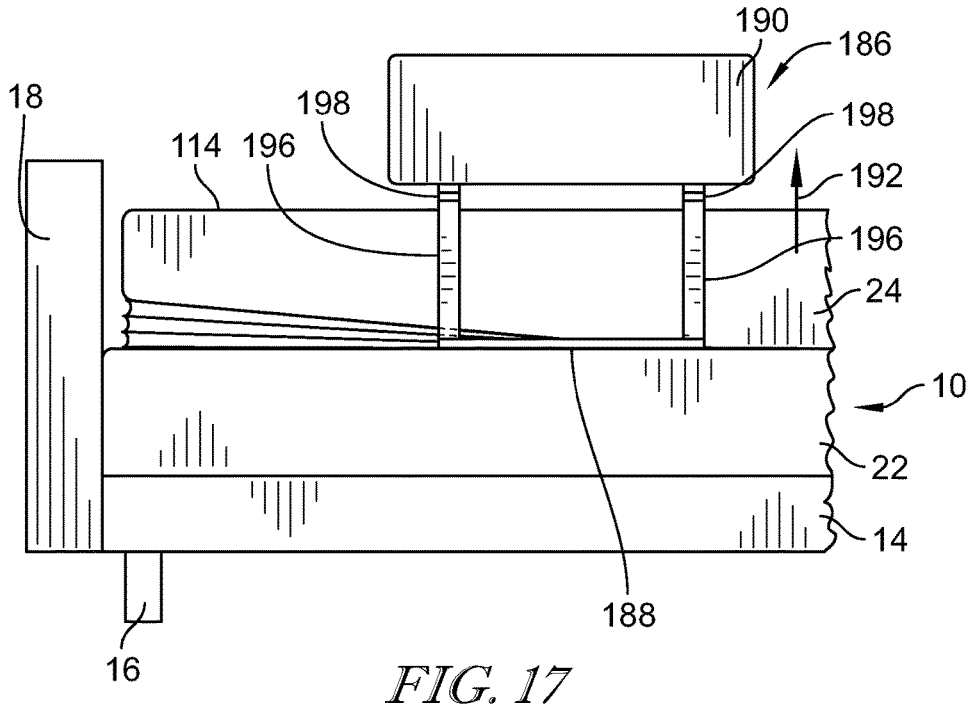
FIG. 17 is a side view of a portion of a bed having an embodiment of a siderail that converts to an over-bed table.
Figure 18:
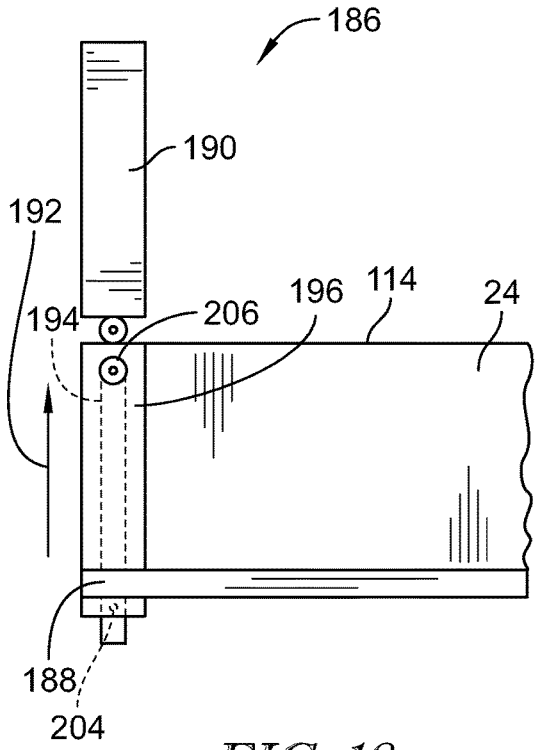
FIG. 18 is an alternative view of the siderail of FIG. 17 showing an end view of the siderail in a siderail configuration.
Figure 19:
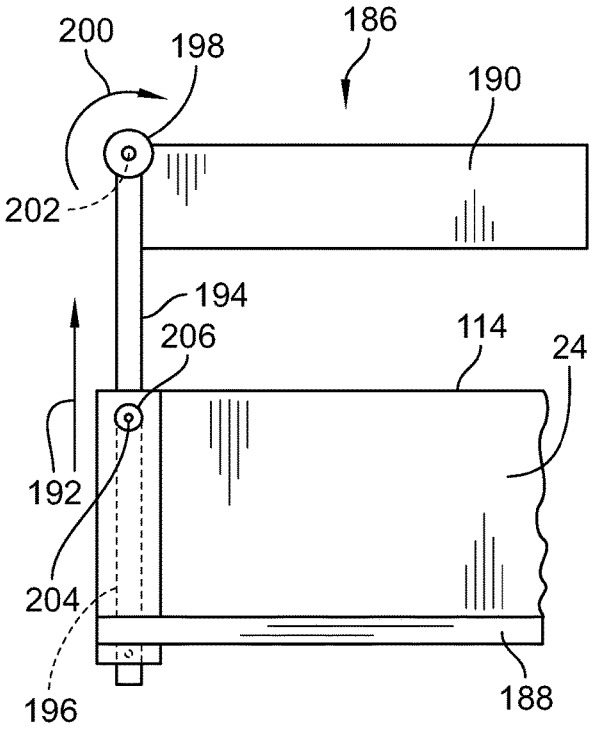
FIG. 19 is a view similar to the view of FIG. 18, the siderail positioned in a table position in FIG. 19.

Referring now to FIG. 17, in another embodiment, a siderail 186 is supported telescopically from a plate 188, a body 190 of the siderail 186 movable relative to the upper surface 114 of the mattress 24 to allow the siderail body 190 to function as an over-bed table for a person supported on the mattress 24. Movement of the body 190 in the direction of arrow 192 causes a pair of inner posts 194 (seen in FIG. 19) to move telescopically relative to an outer post 196 to raise the body 190 relative to the mattress 24. As shown in FIG. 18, the siderail body 190 is supported on each of the inner posts 194 by a coupler 198. When the siderail 186 is fully lowered, the coupler 198 secures the body 190 in the upright position shown in FIGS. 17 and 18. When the body 190 is gripped an pulled upwardly, the coupler 198 releases to allow the body 190 to rotate about an axis 202 so that the body 190 is supported in a position that is generally parallel to the upper surface 114 of the mattress 24. The inner posts 194 includes a detent button 204 that engages a detent receiver 206 formed in outer post 196. The detent buttons 204, 204 engage the detent receivers 206, 206 to retain the inner posts 194 in the extended position shown in FIG. 19 until released by a user to return the siderail 186 to the position shown in FIGS. 17 and 18. When the siderail body 190 is in the position shown in FIG. 19, an upper surface 208 serves as a table surface for a person positioned on the mattress 24.

Figure 20:
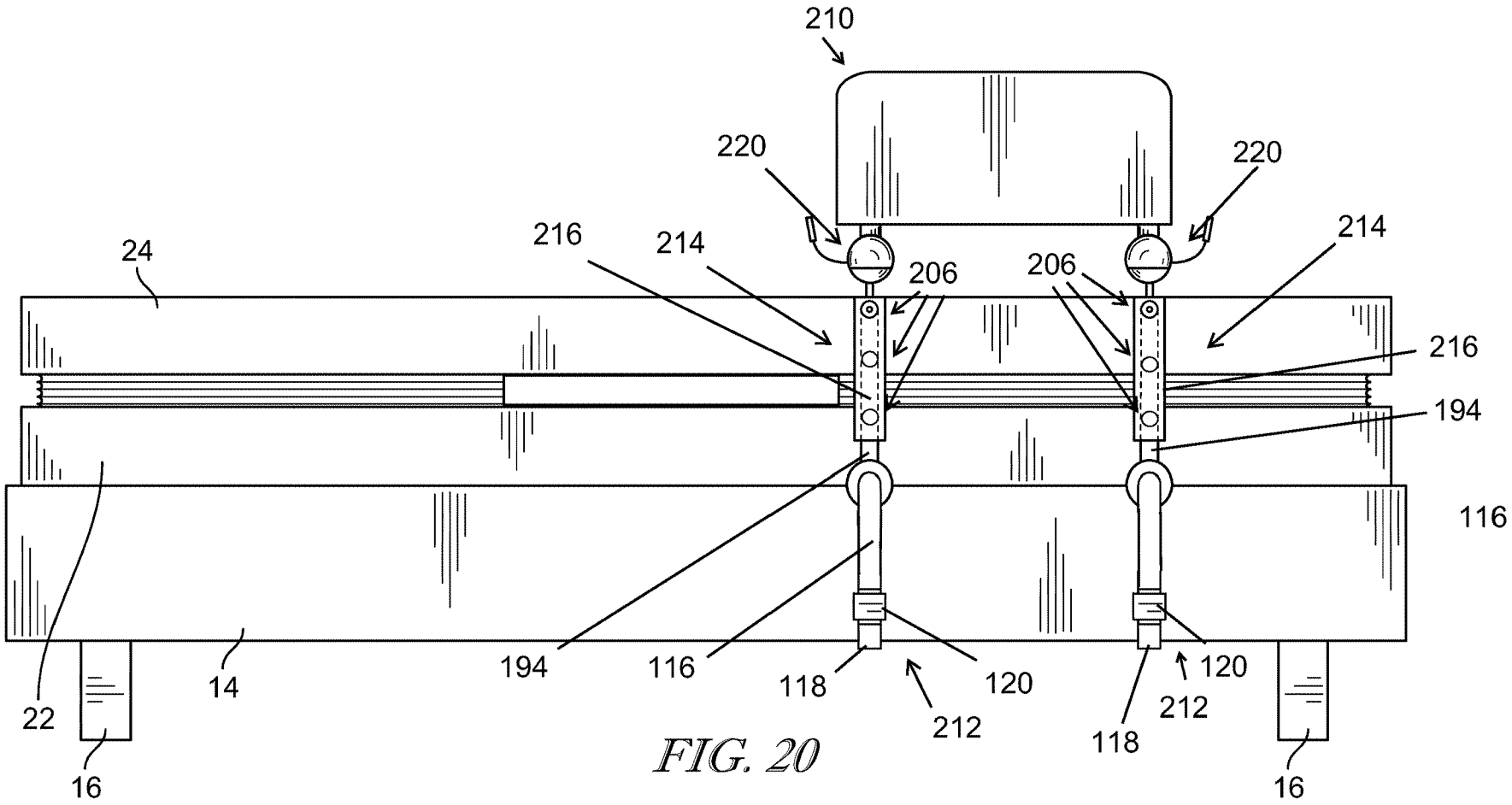
FIG. 20 is a side view of a bed having an embodiment of a siderail that is adjustable at multiple points to adjust the position of the siderail relative to the bed.

In another embodiment shown in FIG. 20, elements of prior embodiments are shown to be combined to provide an adjustable siderail 210 that is supported from the frame 14. The siderail 210 includes a pair of clamps 212, 212 similar to the clamping structure of the egress handle assembly 112 discussed above. The clamps 212, 212 include the clamp arms 116, 118 and the turnbuckle 120. The siderail 210 further includes telescopic posts 214, 214 that are similar to the structure of the siderail 186. However, the posts 214, 214 are modified to include multiple detent receivers 206 so that extension of the inner post 194 relative to an outer post 216 is adjustable to multiple positions which allows a siderail body 218 to be adjusted to a different attitude relative to the mattress 24. The siderail body 218 is supported from the inner posts 194, 194 by manually releasable ball joints 220, 220 which allow for rotation of the body 218 about multiple-axes at each ball joint 220, 220, thereby allowing the siderail body 218 to be adjusted into multiple orientations relative to the person supported on the mattress 24, including serving as barrier or a table. In the embodiment of FIG. 20, the siderail is clamped to the frame 14, but it is also contemplated that the clamps 212, 212 could be secured to the foundation 22 in some embodiments.

Figure 21:
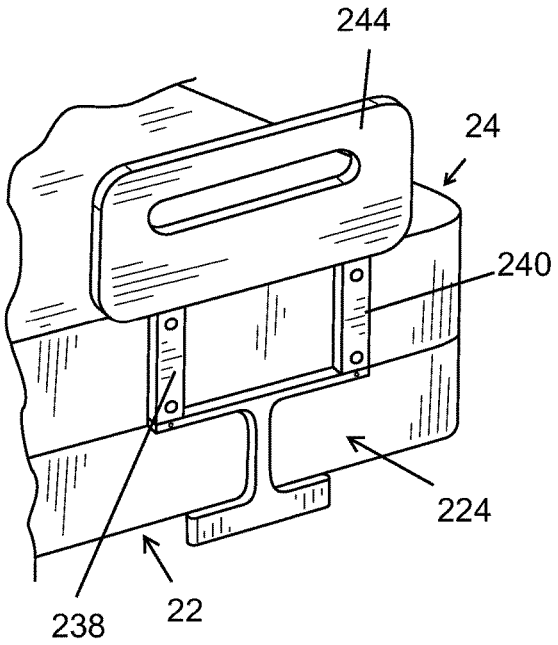
FIG. 21 is a perspective view of a siderail that is secured to the foundation of a bed, the siderail of FIG. 21 being anchored to portions of a head end articulator to move therewith.
Figure 22:
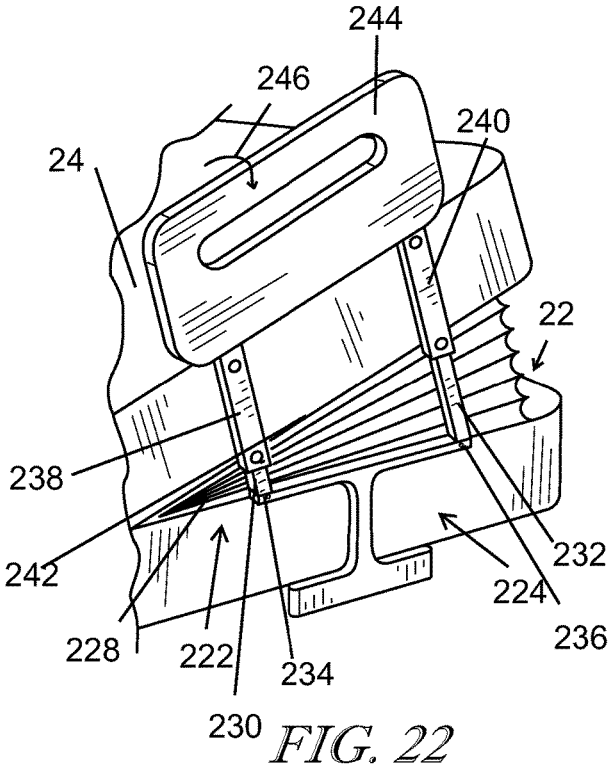
FIG. 22 is a view similar to the view of FIG. 21, the siderail being shown in a raised position in FIG. 22.

In another embodiment shown in FIGS. 21 and 22, a head end articulator 222 is secured to a foundation 22 with a clamp 224. In the illustrative embodiment, the clamp 224 has a fixed height, but may be adjustable similarly to the clamps 212 discussed above in other embodiments. The head end articulator 222 includes a lower plate 228 that pivotably supports two inner telescoping rods 230, 232 at two pivot points 234, 236, respectively. Two outer telescoping posts 238, 240 are secured to an upper plate 242. As the head end articulator 222 raises the mattress 24 relative to the foundation 22, the inner telescopic rods 230, 232 extend from the outer telescoping posts 238, 240 as the plate 242 moves relative to the plate 228. The rods 230, 232, extend at different rates and rotate about their respective pivot points 234, 236. The plates 228, 242, posts 238, 240, rods 230, 232, and clamp 224 cooperate to provide lateral support to a siderail body 244 when a user applies pressure to the siderail body 244 while entering or exiting the bed 10. Any bending moment applied in the direction of arrow 246 is transferred to the clamp 224 and foundation 22 which provide a stable resistant counter force to any pressure 246 applied by a person leaning on the siderail body 244.

Figure 23:
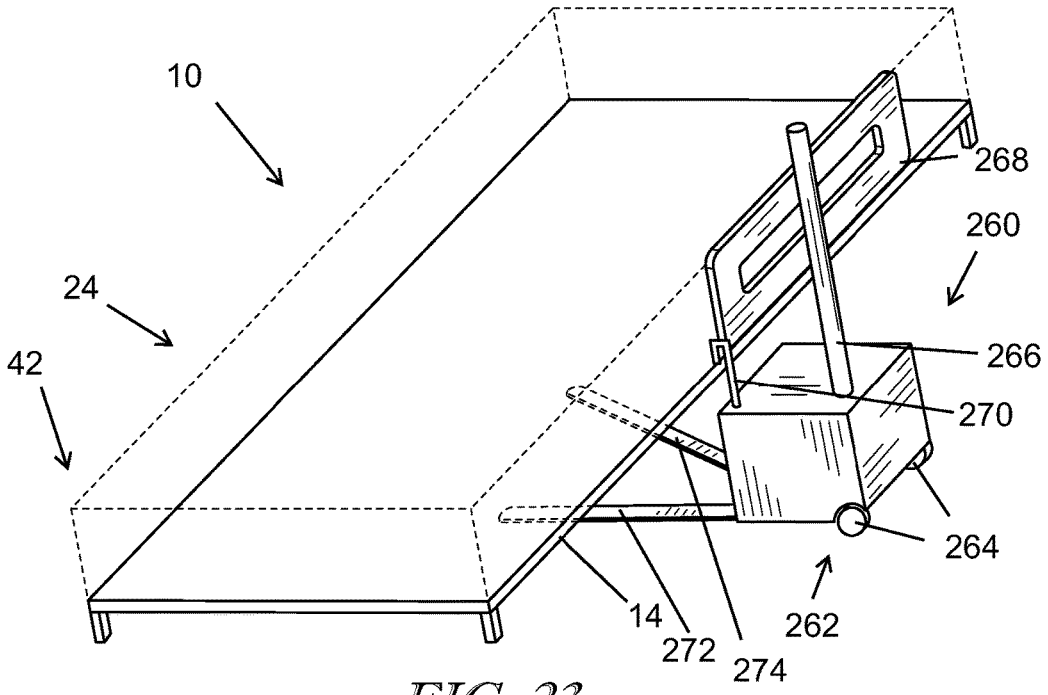
FIG. 23 is a perspective view of a mobile siderail stand positioned adjacent a bed.

In another embodiment shown in FIG. 23, an independent siderail stand 260 includes a rolling base 262 supported on rollers 264, 264. A mast 266 extends upwardly from the base 262 and supports a siderail body 268. The siderail body 268 is movable vertically relative to the mast 266 to change the position of the body 268 relative to a mattress 24. If the head end 42 of the mattress 24 is elevated, then the siderail body 268 can be adjusted to an appropriate vertical position. The siderail body 268 is stabilized by a hook 270 that connects to the frame 14 of the bed 10. In addition, two tabs 272, 274 extend from the base 262 and are positioned under the frame 14 so that any tipping of the siderail stand 260 is precluded by the tabs, 272, 274 contacting the underside of the bed 10/frame 14.

Figure 24:
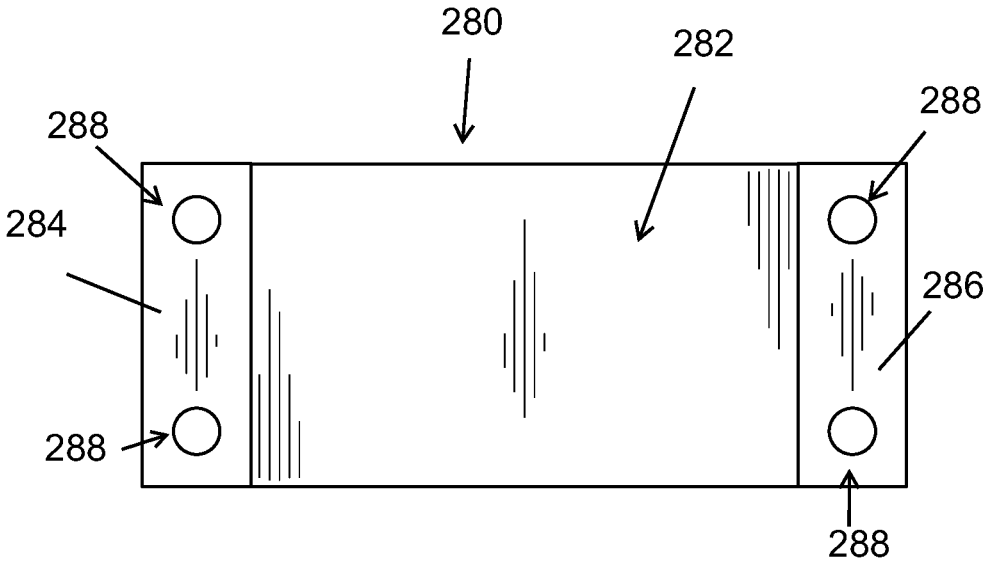
FIG. 24 is top plan view of a siderail support configured to be positioned below a mattress.
Figure 25:
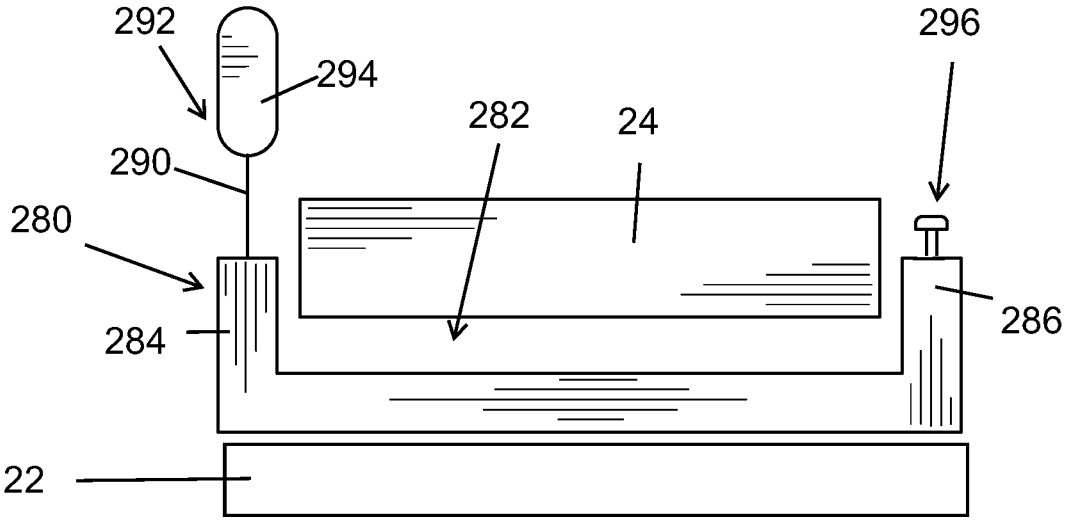
FIG. 25 is an end view of the siderail support of FIG. 24 positioned between a head end articulator and a mattress.

An embodiment of a siderail base 280 is shown diagrammatically in FIGS. 24 and 25. The siderail base 280 is formed to include a channel 282 positioned between two siderail supports 284, 286 positioned on opposite sides of the channel 282. The supports 284, 286 each include two receivers 288, 288 that are configured to receive a post 290 of a siderail 292 so that a siderail body 294 is positioned adjacent a mattress 24 as shown in FIG. 25. The siderail base 280 is acted on by the mattress 24 so that any loads applied to the siderail body 294 are resisted by the siderail base 280. When a receiver 288 is not being used to support a siderail 292, a plug 296 may be positioned in the receiver 288 to cover the receiver 288. A plug 296 is shown partially inserted into a receiver 288 in FIG. 25. The siderail base may be positioned above a head end articulator 22 as suggested in FIG. 25.

Figure 26:
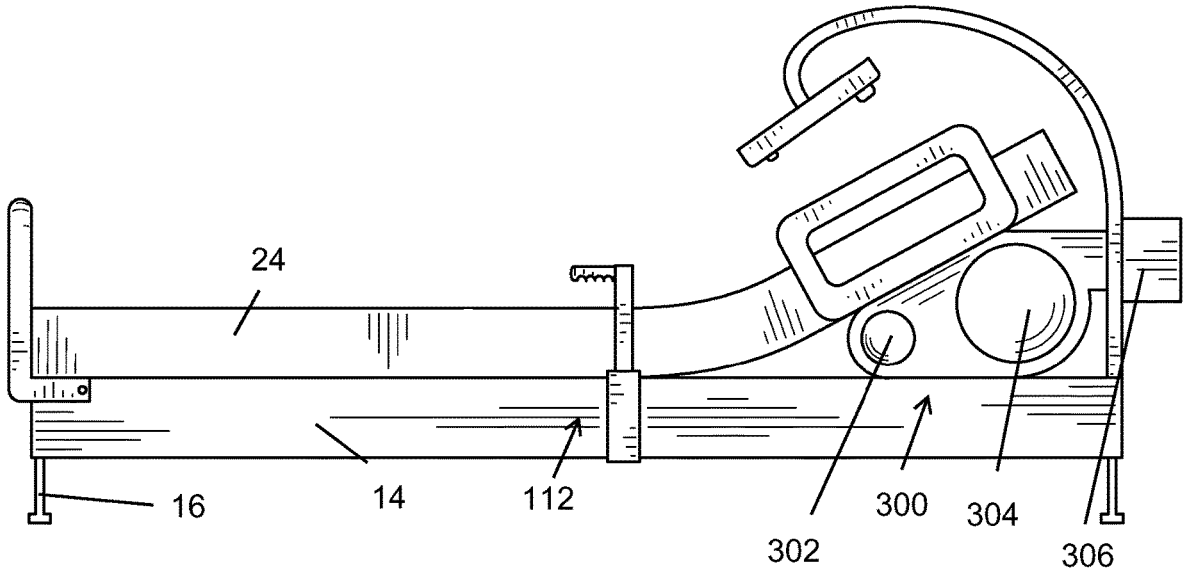
FIG. 26 is a side view of an alternative bed with a modular system for upgrading the bed having a particular group of modular options implemented.
Figure 27:
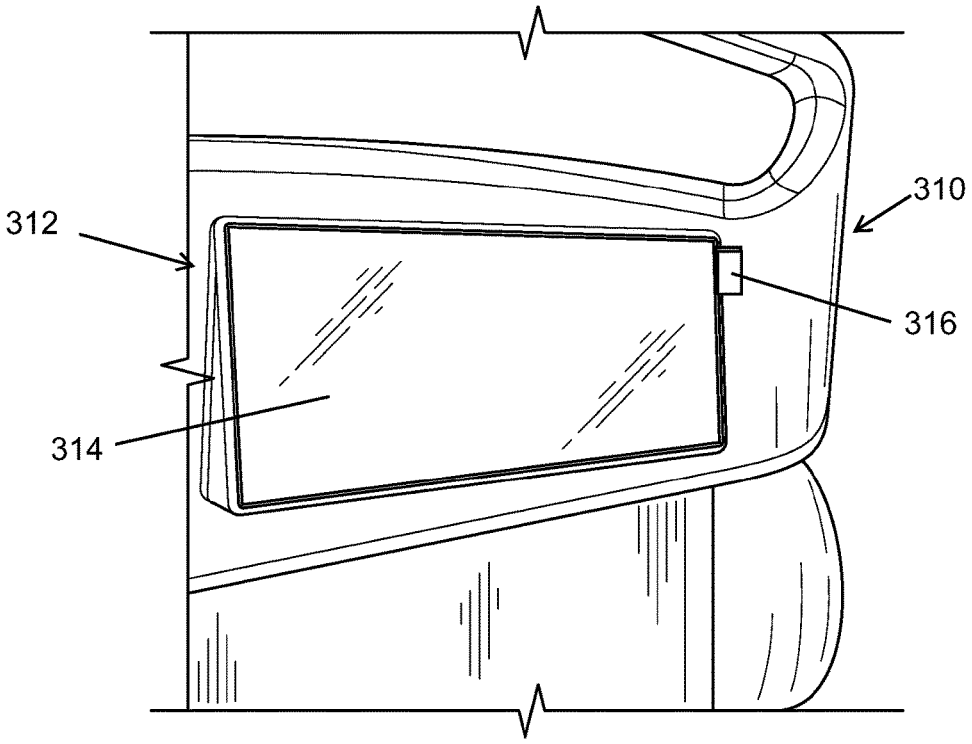
FIG. 27 is a perspective view of a user interface having removable covers.

As shown diagrammatically in FIG. 26, a bed 10 may include various elements disclosed above, including a head end articulator 300 that includes two bladders 302, 304 with circular cross sections. The bladder 304 is larger than the bladder 302 and the two bladders 302, 304 so that they are increased in size in proportion to cause the head end 42 of the mattress 24 to be raised. In the embodiment of FIG. 26, the system 12 includes a control box 306, similar to the control box 26, however the control box 306 is supported on the head board 18 of the bed 10.

The system 12 may be re-usable in some embodiments, such that system elements may be used in a different home by a different patient. To limit the potential for cross-contamination from patient to patient, one solution is to use sterile covers on surfaces that are difficult to clean. As one example, a siderail 310 includes a user interface 312 that has layers of removable transparent covers 314. The force applied to the covers 314 is transferred through the covers 314 to the mechanically actuated switches on the user interface 312. When the siderail 310 is moved to a different location, the out cover is removed by gripping a tab 316 and peeling the outer cover 314 off so that the next layer is exposed. In this way, the outer cover 314 can be discarded and the next layer, which has not been exposed, provides a newly sterile surface. Similar pull away covers may be applied to the articulators 38, 40, or other surfaces that need to be cleaned but may be difficult to clean.

Figure 28:
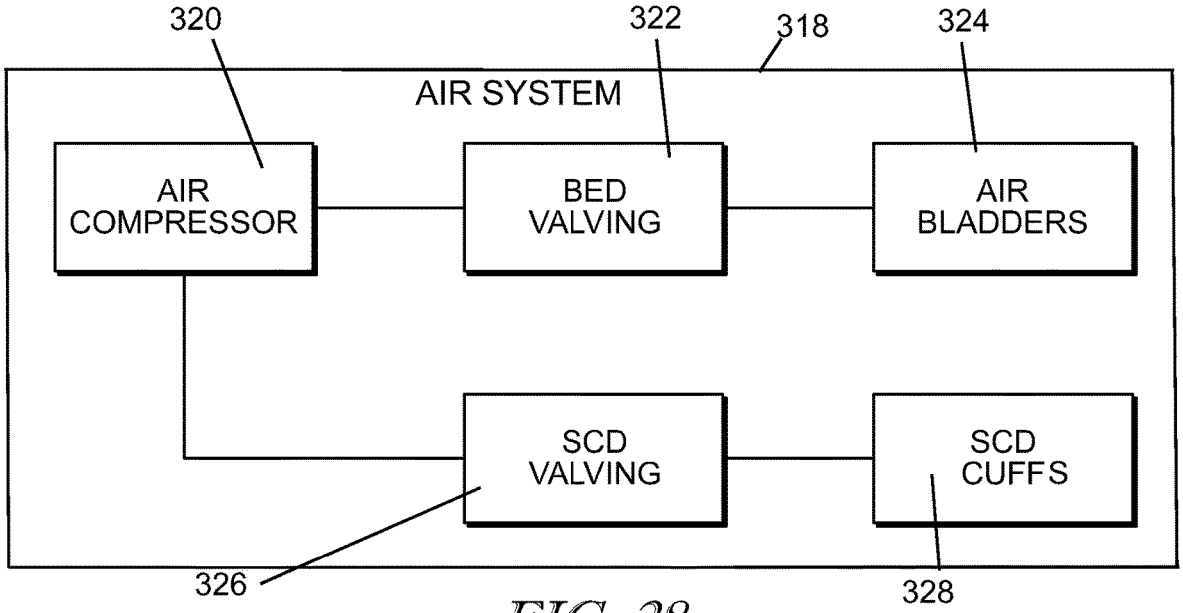
FIG. 28 is a diagrammatic view of one embodiment of an air system of the modular system of the present disclosure.

In some embodiments, the control box 26 may include an air system 318 having additional functionality, such as, for example, the ability to operate a sequential compression device (SCD) in conjunction with operating the articulators 38, 40. For example, the diagram in FIG. 28 shows that an air compressor 320 may feed both the bed articulators 38, 40 and an SCD by having the air compressor 320 feed the valving 322 for the air bladders 324 of the articulators 38, 40, while simultaneously feeding SCD valving 326 that controls the operation of SCD cuffs 328.

Figure 29:
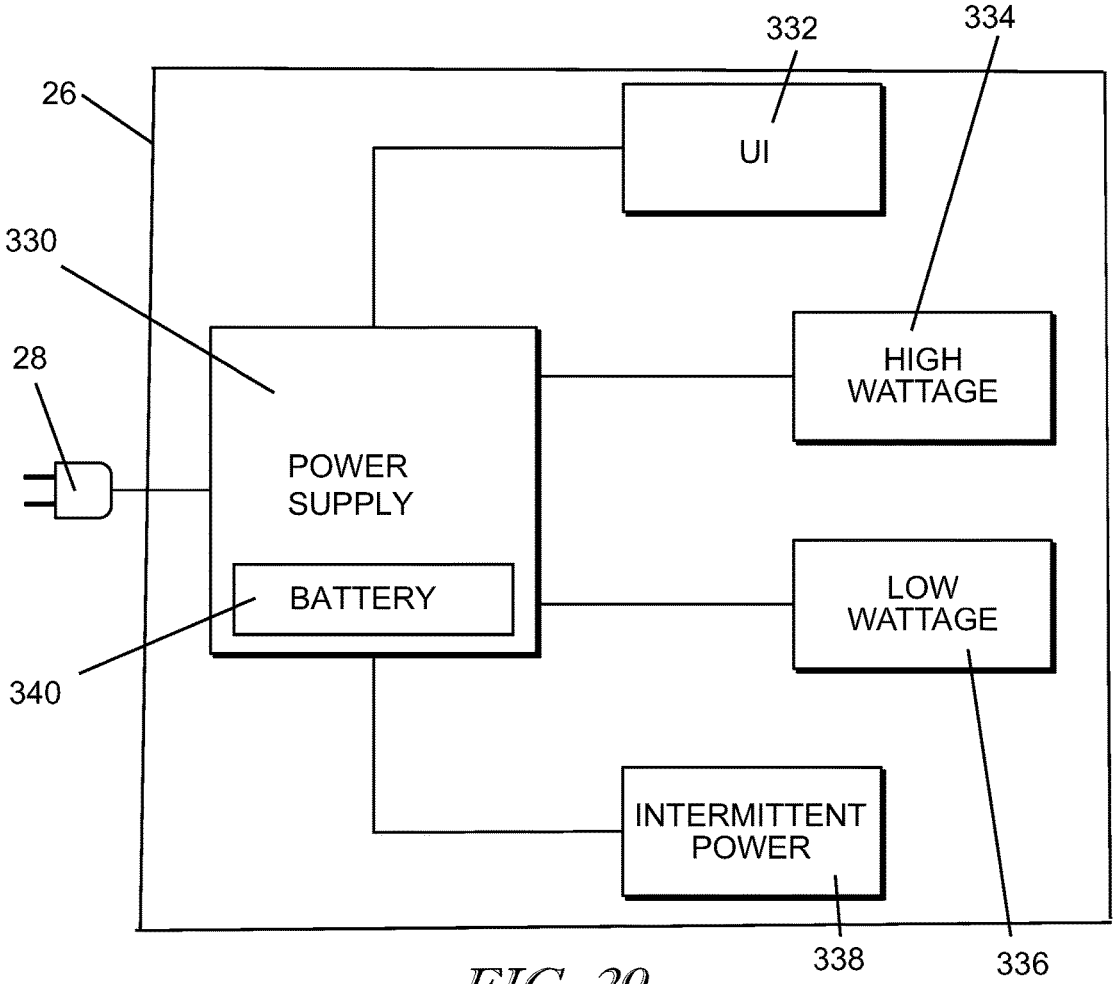
FIG. 29 is a diagrammatic view of one embodiment of an control box of the modular system of the present disclosure.

In some embodiments, the control box 26 may include a power supply 330 that is configured to power multiple devices or circuits, as shown diagrammatically in FIG. 29. The power supply 330 is configured to operate low voltage circuitry such as the user interface (UI) 332. The power supply 330 may also be configured to condition the power from the power cord 28 to provide a high wattage power source 334, such as, for example, a ventilator. There also may be a need to supply a low wattage power source 336, such as for monitoring equipment, such as a heart rate monitor. Still further, the power supply 330 may also be capable of providing an intermittent power source 338, such as, for example, operation of the compressor 320. The power supply 330 includes a battery 340 that charges during low usage times and provides a back-up power supply to the various power sources 332, 334, 336, and 338. In addition, when the load applied by the power sources 332, 334, 336, and 338 exceeds the capacity of the power from the power cord 28, the battery 340 provides additional temporary power for the power sources 332, 334, 336, and 338.

Figure 30:
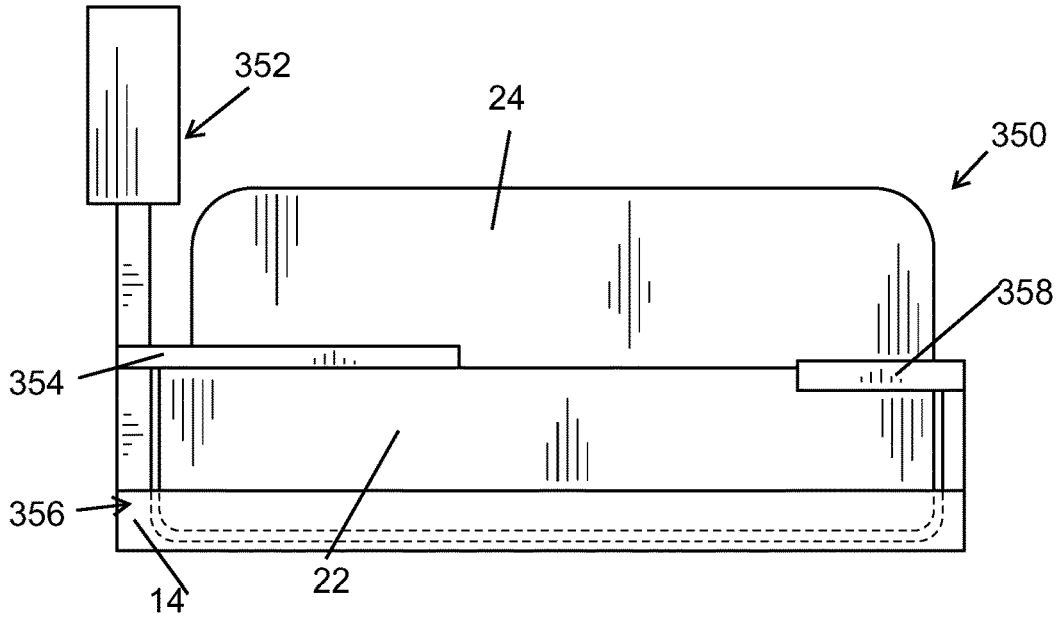
FIG. 30 is a diagrammatic view of a particular system for anchoring a siderail to a bed.

Referring now to FIG. 30, an anchoring system 350 for providing support for a siderail 352 positioned adjacent a mattress 24 includes a plate 354 positioned under the mattress 24 and above the foundation 22 with the siderail 352 supported from the plate 354. As shown diagrammatically in FIG. 30, a tether 356 is attached to the plate 354 and traverses under the foundation (as shown in phantom) and connects to a second plate 358. The plate 358 is also positioned between the mattress 24 and foundation 22. When a load is applied to the siderail 352, the load is counteracted by the plate 354 and the tether 356 transfers a portion of the load through to the plate 358 which provides additional resistance. This helps maintain the stability of the siderail 352.

Figure 31:
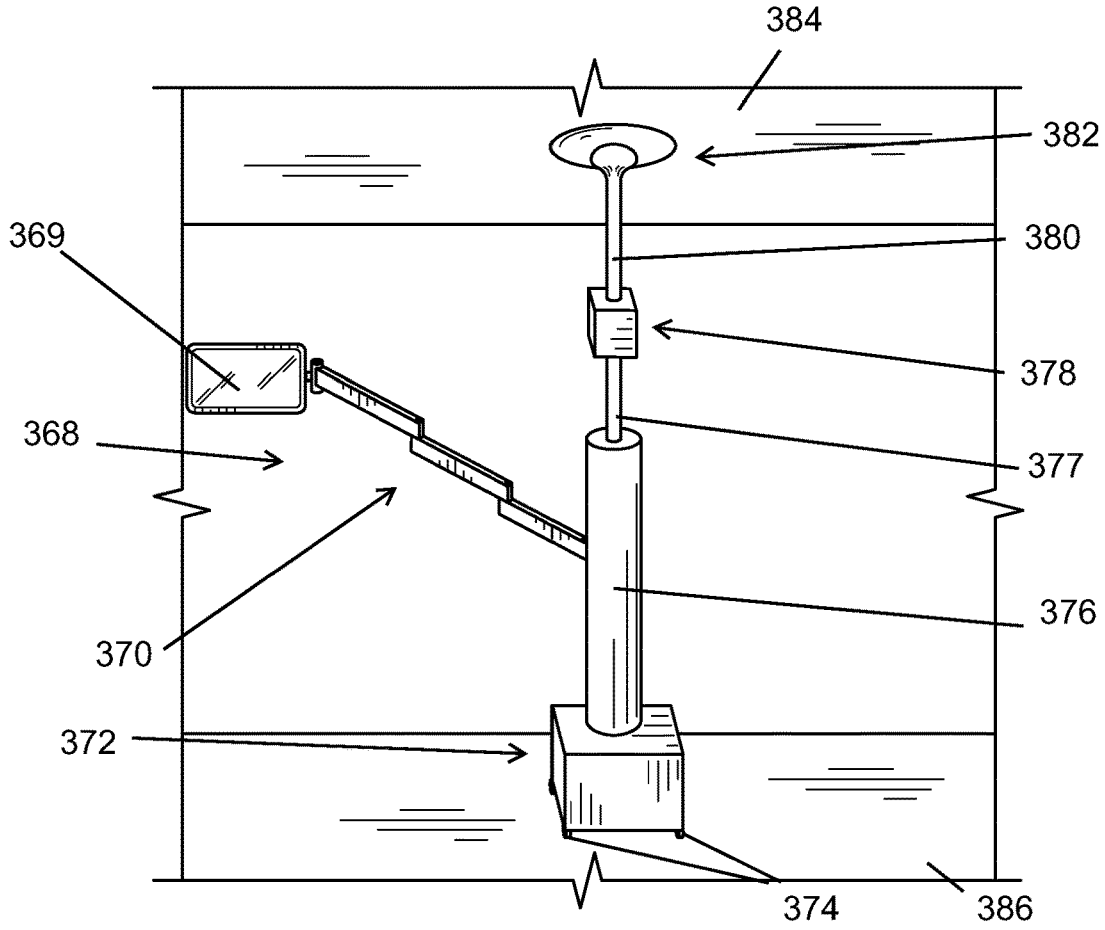
FIG. 31 is a perspective view of a mobile power supply and siderail support of the present disclosure.

FIG. 31 shows a utility cart 368 which is movable on rollers 374 across a floor 386. The utility cart 368 includes a base 372 which may house the structures found in the control box 26, including the air system 318, the power supply 330, the compressor 30, and the controller 32. The base 372 supports a mast 376, a telescopic post 377 that moves relative to the mast 376, an upper post 380 which engages a load distributor 382 to engage against a ceiling 384, and a locking mechanism 378 interposed between the telescopic post 377 and the upper post 380. In the illustrative embodiment, the locking mechanism 378 comprises a spring-loaded lock that urges the upper post 380 against the load distributor to cause a load in the cart 368 so that that the cart 368 is secured between the floor 386 and ceiling 384. The mast 376 is similar to the mast 266 discussed above and may be configured to support a siderail, such as siderail 368, for example. The cart 368 may be positioned adjacent a bed 10 in a manner similar to the cart 260 to provide support for various portions of the modular system 12. In the illustrative embodiment of FIG. 31, the mast 376 supports a table 369 on a multi-arm support 370, similar to the multi-arm support 158 discussed above.

Although this disclosure refers to specific embodiments, it will be understood by those skilled in the art that various changes in form and detail may be made without departing from the subject matter set forth in the accompanying claims.

The invention claimed is:

1. A modular system for upgrading a home bed having a mattress to move portions of the bed, the modular system comprising a head end articulator comprising a lower plate, an upper plate pivotably coupled to the lower plate, and an expandable structure operable to move the upper plate relative to the lower plate to pivot the upper plate and cause a head end of the mattress to raise, and a control box operable to control the operation of the head end articulator, wherein the modular system comprises an overhead arm supported from the upper plate by a tapered fit connection.

2. The modular system of claim 1, further comprising a user interface supported on a siderail supported from the upper plate to move with the upper plate as the upper plate moves relative to the lower plate.

3. The modular system of claim 2, wherein the user interface includes user inputs to control the operation of the head end articulator.

4. The modular system of claim 3, wherein the control box includes a power supply, a controller, and a compressor.

5. The modular system of claim 4, wherein the power supply provides a low wattage power source for supporting equipment.

6. The modular system of claim 1, wherein the modular system includes an egress handle.

7. The modular system of claim 6, wherein the egress handle clamps to a frame of the bed.

8. The modular system of claim 6, wherein the egress handle clamps to a foundation of the bed.

9. The modular system of claim 6, wherein the control box is mounted to a headboard of the bed.

10. The modular system of claim 6, wherein the modular system further comprises a suspension system for supporting medical equipment adjacent the bed.

11. The modular system of claim 1, wherein the upper plate includes a cup and a portion of the overhead arm is received in the cup.

12. The modular system of claim 1, wherein the siderail is further supported from the lower plate.

13. The modular system of claim 1, wherein the siderail is telescopically adjustable.

14. A modular system for upgrading a home bed having a mattress to move portions of the bed, the modular system comprising a head end articulator comprising a lower plate, an upper plate pivotably coupled to the lower plate, and an expandable structure operable to move the upper plate relative to the lower plate to pivot the upper plate and cause a head end of the mattress to raise, a siderail supported from the upper plate to move with the upper plate as the upper plate moves relative to the lower plate, and a control box operable to control the operation of the head end articulator, wherein the modular system includes an egress handle, wherein the modular system comprises an overhead arm, wherein the overhead arm is supported from the upper plate, wherein the overhead arm includes a threaded portion that passes through a portion of the plate and is secured to the plate by the threaded portion.

15. A modular system for upgrading a home bed having a mattress to move portions of the bed, the modular system comprising a head end articulator comprising a lower plate, an upper plate pivotably coupled to the lower plate, and an expandable structure operable to move the upper plate relative to the lower plate to pivot the upper plate and cause a head end of the mattress to raise, a siderail supported from the upper plate to move with the upper plate as the upper plate moves relative to the lower plate, and a control box operable to control the operation of the head end articulator, wherein the siderail is telescopically adjustable, wherein the siderail is pivotably coupled to the lower plate.

16. The modular system of claim 15, wherein the user interface includes user inputs to control the operation of the head end articulator.

17. The modular system of claim 15, wherein the control box includes a power supply, a controller, and a compressor.

18. The modular system of claim 17, wherein the power supply provides a low wattage power source for supporting equipment.

19. A modular system for upgrading a home bed having a mattress to move portions of the bed, the modular system comprising a head end articulator comprising a lower plate, an upper plate pivotably coupled to the lower plate, and an expandable structure operable to move the upper plate relative to the lower plate to pivot the upper plate and cause a head end of the mattress to raise, a siderail supported from the upper plate to move with the upper plate as the upper plate moves relative to the lower plate, and a control box operable to control the operation of the head end articulator, wherein the siderail is telescopically adjustable, wherein the siderail converts to an over-bed table.

20. The modular system of claim 19, wherein the siderail comprises a siderail body that is supported by lockable ball joints such that the siderail body can be adjusted to multiple orientations relative to the mattress.

* * * * *